US010731609B2

(12) United States Patent
Quix et al.

(10) Patent No.: US 10,731,609 B2
(45) Date of Patent: Aug. 4, 2020

(54) METHODS AND SYSTEMS FOR ENERGY RECOVERY VIA AN EGR COOLER

(71) Applicant: Ford Global Technologies, LLC, Dearborn, MI (US)

(72) Inventors: Hans Guenter Quix, Herzogenrath (DE); Andreas Kuske, Geulle (NL); Christian Vigild, Aldenhoven (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/182,379

(22) Filed: Nov. 6, 2018

(65) Prior Publication Data

US 2019/0145359 A1 May 16, 2019

(30) Foreign Application Priority Data

Nov. 16, 2017 (DE) ..... 10 2017 220 441
Nov. 22, 2017 (DE) ..... 10 2017 220 844

(51) Int. Cl.
*F02B 47/08* (2006.01)
*F02M 26/33* (2016.01)
*F02M 26/23* (2016.01)
*F02M 26/17* (2016.01)

(52) U.S. Cl.
CPC ..... *F02M 26/33* (2016.02); *F02M 26/17* (2016.02); *F02M 26/23* (2016.02)

(58) Field of Classification Search
CPC ..... F02M 26/33; F02M 26/17; F02M 26/23; F02M 26/11; F02M 26/22; F02M 26/29
USPC ..... 123/568.12, 568.17; 60/605.2, 320
See application file for complete search history.

(56) References Cited

U.S. PATENT DOCUMENTS

| | | | | |
|---|---|---|---|---|
| 8,132,407 | B2 | 3/2012 | Li et al. | |
| 8,794,195 | B2 | 8/2014 | Levin et al. | |
| 8,997,707 | B2 * | 4/2015 | Ulrey | B60H 1/14 123/142.5 R |
| 10,233,817 | B2 * | 3/2019 | Uhrich | F02M 26/06 |
| 10,294,874 | B2 * | 5/2019 | Styles | F02D 17/04 |
| 10,323,587 | B2 * | 6/2019 | Schwartz | F02D 41/064 |
| 2011/0048388 | A1 | 3/2011 | Takahashi et al. | |
| 2014/0345579 | A1 | 11/2014 | Keppy | |
| 2019/0331018 | A1 * | 10/2019 | Quix | F01N 5/02 |

FOREIGN PATENT DOCUMENTS

| | | | |
|---|---|---|---|
| DE | 102008020408 | A1 | 10/2009 |
| DE | 102009015656 | A1 | 10/2009 |
| JP | 2015200435 | A | 11/2015 |
| JP | 2016118117 | A | 6/2016 |

OTHER PUBLICATIONS

Bhaskar, S. et al., "Investigation of Phase Change Material as a Potential Replacement of EGR Cooler," Applied Mechanics and Materials, vol. 798, Oct. 2015, 4 pages.

* cited by examiner

*Primary Examiner* — Hai H Huynh
(74) *Attorney, Agent, or Firm* — Geoffrey Brumbaugh; McCoy Russell LLP

(57) ABSTRACT

Methods and systems are provided for an EGR cooler comprising a phase-change material. In one example, exhaust gas may be conducted through the EGR cooler when an engine is deactivated to maintain an engine temperature.

19 Claims, 15 Drawing Sheets

METHODS AND SYSTEMS FOR ENERGY RECOVERY VIA AN EGR COOLER

CROSS REFERENCE TO RELATED APPLICATIONS

The present application claims priority to German Patent Application No. 102017220441.9, filed Nov. 16, 2017, and to German Patent Application No. 102017220844.9, filed Nov. 22, 2017. The entire contents of each of the above-referenced applications are hereby incorporated by reference in their entirety for all purposes.

FIELD

The present description relates generally to an exhaust-gas recirculation (EGR) arrangement which comprises at least one recirculation line comprising an EGR cooler.

BACKGROUND/SUMMARY

An internal combustion engine of the present description may be used as a motor vehicle drive unit. Within the context of the present disclosure, the expression "internal combustion engine" encompasses diesel engines and Otto-cycle engines, but also hybrid internal combustion engines, that is to say internal combustion engines which are operated with a hybrid combustion process, and hybrid drives which, in addition to the internal combustion engine, comprise at least one further torque source for driving a motor vehicle, for example an electric machine which is connectable in terms of drive to the internal combustion engine and which outputs power instead of the internal combustion engine or in addition to the internal combustion engine.

In the development of internal combustion engines, it may be constantly sought to minimize fuel consumption. Furthermore, a reduction of the pollutant emissions is sought in order to be able to comply with future limit values for pollutant emissions.

Internal combustion engines may be equipped with a supercharging arrangement, wherein supercharging is associated with a method for increasing power, in which the charge air used for the combustion process in the engine is compressed, as a result of which a greater mass of charge air can be supplied to each cylinder per working cycle. In this way, the fuel mass and therefore the mean pressure can be increased.

Supercharging may be a suitable method for increasing the power of an internal combustion engine while maintaining an unchanged swept volume, or for reducing the swept volume while maintaining the same power. In most cases, supercharging may lead to an increase in volumetric power output and a more expedient power-to-weight ratio. If the swept volume is reduced, it is possible, given the same vehicle boundary conditions, to shift the load collective toward higher loads, at which the specific fuel consumption is lower. Supercharging of an internal combustion engine may serendipitously assist in the efforts to minimize fuel consumption, that is to say to improve the efficiency of the internal combustion engine.

A suitable transmission configuration may additionally allow downspeeding, whereby a lower specific fuel consumption is likewise achieved. In the case of downspeeding, use is made of the fact that the specific fuel consumption at low engine speeds is generally lower, in particular in the presence of relatively high loads.

With targeted configuration of the supercharging, it is also possible to obtain advantages with regard to the exhaust-gas emissions. With suitable supercharging for example of a diesel engine, the nitrogen oxide emissions can therefore be reduced without any losses in efficiency. At the same time, the hydrocarbon emissions can be positively influenced. The emissions of carbon dioxide, which correlate directly with fuel consumption, likewise decrease with falling fuel consumption.

To comply with future limit values for pollutant emissions, however, further measures may be desired. One example may include nitrogen oxides, wherein the reduction of nitrogen oxide emissions, which are of high relevance in particular in diesel engines. Since the formation of nitrogen oxides occurs with not only an excess of air but also high temperatures, one concept for lowering the nitrogen oxide emissions consists of using combustion processes with lower combustion temperatures.

Here, exhaust-gas recirculation (EGR), that is to say the recirculation of combustion gases from the outlet side (e.g., exhaust system) to the inlet side (e.g., intake system), may be desired in achieving this aim, wherein it is possible for the nitrogen oxide emissions to be reduced by increasing exhaust-gas recirculation rate. Here, the exhaust-gas recirculation rate $x_{EGR}$ is determined as $x_{EGR}=m_{EGR}/(m_{EGR}+m_{fresh\ air})$, where $m_{EGR}$ denotes the mass of recirculated exhaust gas and $m_{fresh\ air}$ denotes the supplied fresh air. The oxygen provided via exhaust-gas recirculation may be taken into consideration.

To obtain a considerable reduction in nitrogen oxide emissions, high exhaust-gas recirculation rates may be used, which may be of the order of magnitude of $x_{EGR}\approx 60\%$ to 70% or more. Such high recirculation rates may demand cooling of the exhaust gas for recirculation, by which the temperature of the exhaust gas may be reduced and the density of the exhaust gas increased, so that a greater mass of exhaust gas can be recirculated. Consequently, an exhaust-gas recirculation arrangement may be equipped with a cooler. The exhaust-gas recirculation arrangement of the internal combustion engine to which the present disclosure relates comprises a cooling arrangement, that is to say at least one EGR cooler, which has a coolant-conducting coolant jacket which serves for the transfer of heat between exhaust gas and coolant.

Problems can arise during the introduction of the recirculated exhaust gas into the intake system if the temperature of the recirculated hot exhaust gas decreases and condensate forms. Firstly, condensate may form if the recirculated hot exhaust gas meets, and is mixed with, cool fresh air in the intake system. The exhaust gas cools down, whereas the temperature of the fresh air is increased. The temperature of the mixture of fresh air and recirculated exhaust gas, that is to say the temperature of the combustion air, lies below the exhaust-gas temperature of the recirculated exhaust gas. During the course of the cooling of the exhaust gas, liquids previously contained in the exhaust gas and/or in the combustion air still in gaseous form, in particular water, may condense out if the dew point temperature of a component of the gaseous combustion-air flow is undershot. Condensate formation occurs in the free combustion-air flow, wherein contaminants in the combustion air often form the starting point for the formation of condensate droplets.

Secondly, condensate may form when the recirculated hot exhaust gas and/or the combustion air impinges on the internal wall of the intake system, as the wall temperature may lie below the dew point temperature of the relevant gaseous components.

Condensate and condensate droplets may be undesirable and lead to increased noise emission in the intake system and may collide with the impeller blades of a compressor impeller, which is arranged in the intake system, of a supercharger or of an exhaust-gas turbocharger. The latter effect is associated with a reduction in efficiency of the compressor and may degrade the impeller blades.

With regard to the issue of the above-described condensate formation, too, an EGR cooler may be expedient or helpful. The cooling of the exhaust gas for recirculation during the course of the recirculation has the advantageous effect that the condensate does not form for the first time in the intake system but forms already during the recirculation, and can be separated off during the course of the recirculation.

A disadvantage of the EGR coolers according to the prior art is that, owing to the principle involved, the useful exhaust-gas energy, that is to say the heat that can be extracted from the exhaust gas in the cooler via coolant, is only available and usable when exhaust gas is being recirculated. If the exhaust-gas recirculation arrangement has been deactivated, such that no exhaust gas is being recirculated, the exhaust-gas energy of the hot exhaust gas often remains unutilized. If it were possible to utilize said exhaust-gas energy without restriction, that is to say to recover said exhaust-gas energy in the context of energy recuperation, it would be possible to achieve further efficiency advantages in the internal combustion engine.

The energy of the hot exhaust gas may, for example, be utilized to reduce the friction losses and thus the fuel consumption of the internal combustion engine. Here, rapid warming of the engine oil via exhaust-gas heat, in particular after a cold start, could be expedient. Fast warming of the engine oil during the warm-up phase of the internal combustion engine ensures a correspondingly fast decrease in the viscosity of the oil and thus a reduction in friction and friction losses, in particular in the bearings which are supplied with oil, for example the bearings of the crankshaft.

Here, the oil could for example be actively warmed via a heating device. For this purpose, it is possible in the warm-up phase for a coolant-operated oil cooler to be utilized, contrary to its intended purpose, for warming the oil.

Fast warming of the engine oil in order to reduce friction losses may basically also be promoted via fast heating of the internal combustion engine itself, which in turn is assisted, that is to say forced, by virtue of as little heat as possible being extracted from the internal combustion engine during the warm-up phase.

In this respect, in the case of a liquid-cooled internal combustion engine, it may also be expedient for heat to be supplied to the coolant of the engine cooling arrangement, in particular in the warm-up phase or after a cold start. It would be possible for the exhaust-gas energy to be utilized for warming the coolant of the engine cooling arrangement.

One previous example, shown in German publication DE 10 2008 020 408 A1 describes an internal combustion engine in which the exhaust-gas energy may be used even when no exhaust gas is being recirculated. That is to say, exhaust-gas energy may be used even when no exhaust gas is being taken from the intake system and introduced into the exhaust-gas discharge system. The return line may be connected optionally to the intake system and/or to the exhaust gas discharge system downstream of the EGR cooler using a control valve which also serves as an EGR valve. Even when the exhaust-gas recirculation arrangement is deactivated and no exhaust gas is being recirculated, the exhaust-gas energy from the hot gases may be used for energy recuperation. The recuperated energy is either used to heat the engine oil more quickly after a cold start, and in this way reduce the friction losses, or to heat the vehicle cabin.

It may also be a disadvantage of EGR coolers according to the prior art that the coolers do not have to be configured with regard to effective energy recovery, with the focus rather being on the cooling of the exhaust gas, that is to say the pure cooling effect. Here, the cooler may be able to cope with all exhaust-gas flow rates for recirculation via the exhaust-gas recirculation arrangement during the operation of the internal combustion engine. In particular, the cooler may be configured to provide cooling to a maximum exhaust-gas flow rate for recirculation. The range of variation of the exhaust-gas flow rate for recirculation via the exhaust-gas recirculation arrangement leads to widely varying pressure conditions at the cooler. The pressure gradient across the cooler changes noticeably in a manner dependent on the exhaust-gas flow rate for recirculation, that is to say in such a relevant manner that it may be taken into consideration in the control or setting of the recirculation rate. The resulting interaction leads to certain dynamics, and demands correspondingly complex or intricate control of the exhaust-gas recirculation arrangement.

The inventors herein have recognized the potential issues with such systems and have come up with a way to at least partially solve them. In one example, the issues described above may be addressed by a method comprising flowing exhaust gas heated via an EGR cooler arranged along a recirculation line to an intake system during an engine deactivation and heating the exhaust gas via an EGR cooler. In this way, EGR may flow to the engine during an engine deactivation even if an EGR request is absent.

As one example, by intrusively flowing EGR during the engine deactivation, the EGR cooler may warm up the EGR via a phase-change material. Heat may be recuperated from exhaust gas during combusting conditions of the engine, wherein the heat may be released to the EGR during the engine deactivation if desired. By doing this, an engine temperature may be maintained, which may decrease frictional losses and increase fuel economy.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
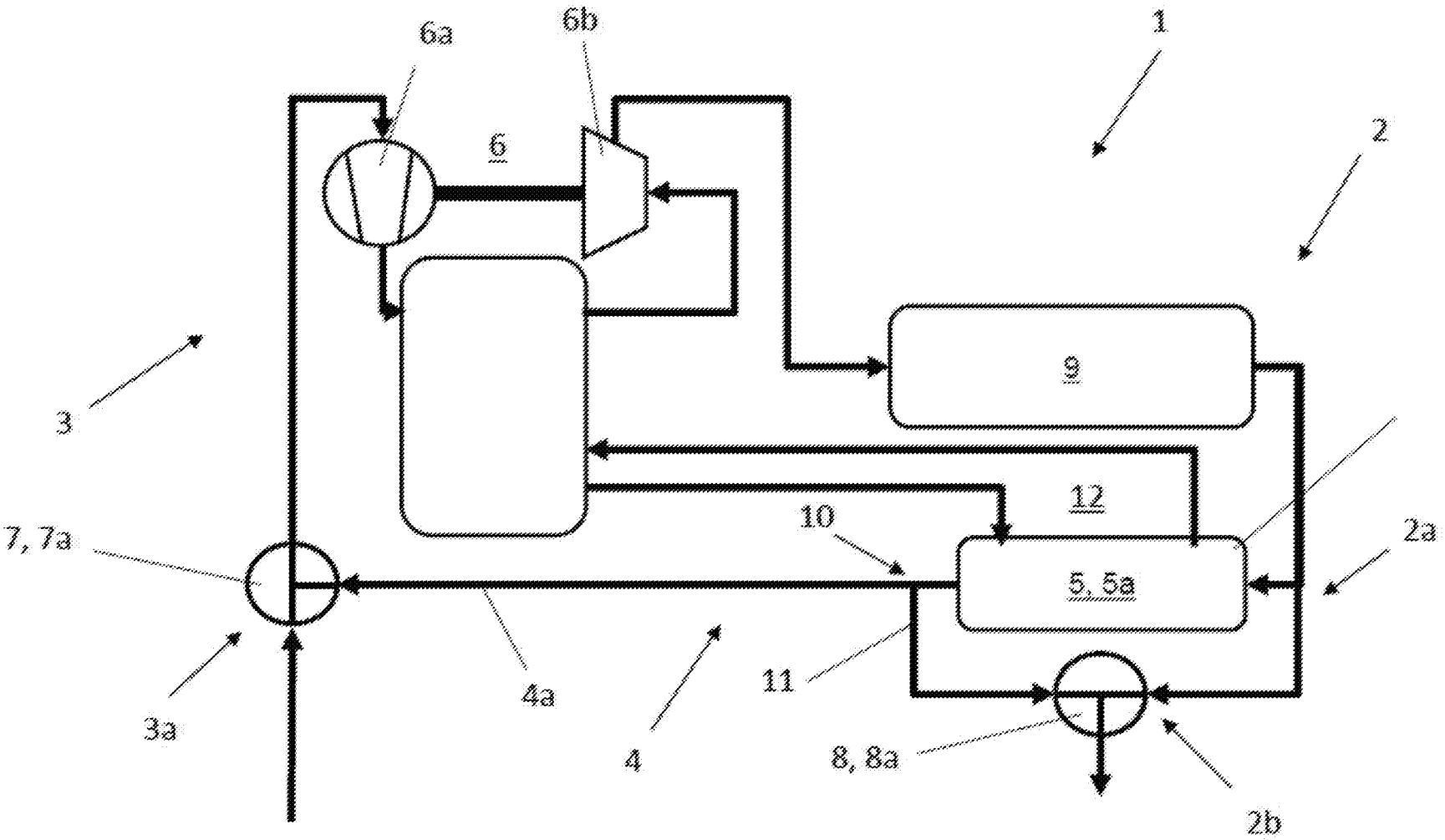
FIG. 1 schematically shows the first embodiment of the internal combustion engine together with exhaust-gas recirculation arrangement.
Figure 2:
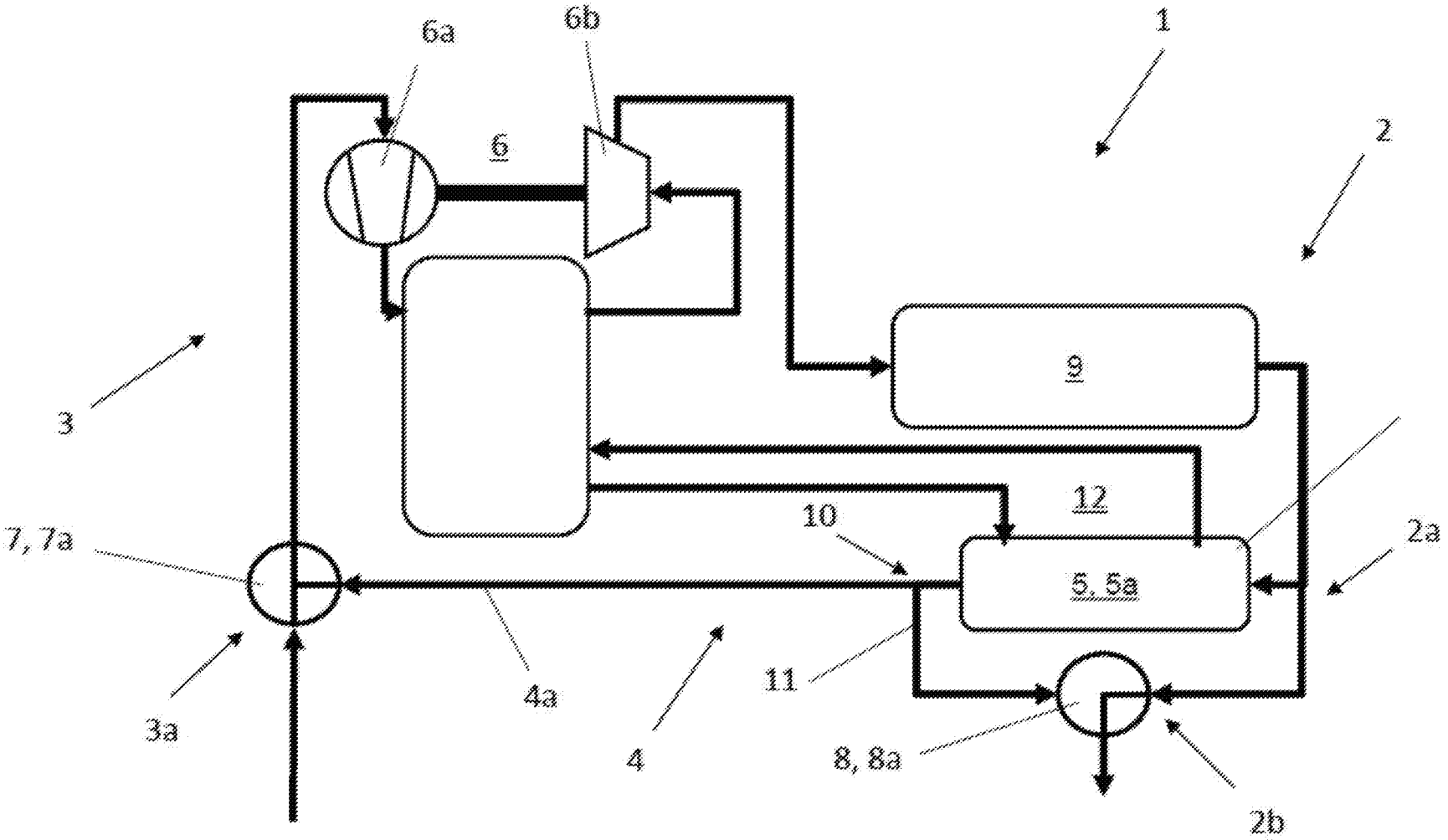
FIG. 2 schematically shows the first embodiment of the internal combustion engine together with exhaust-gas recirculation arrangement in a first operating mode.
Figure 3:
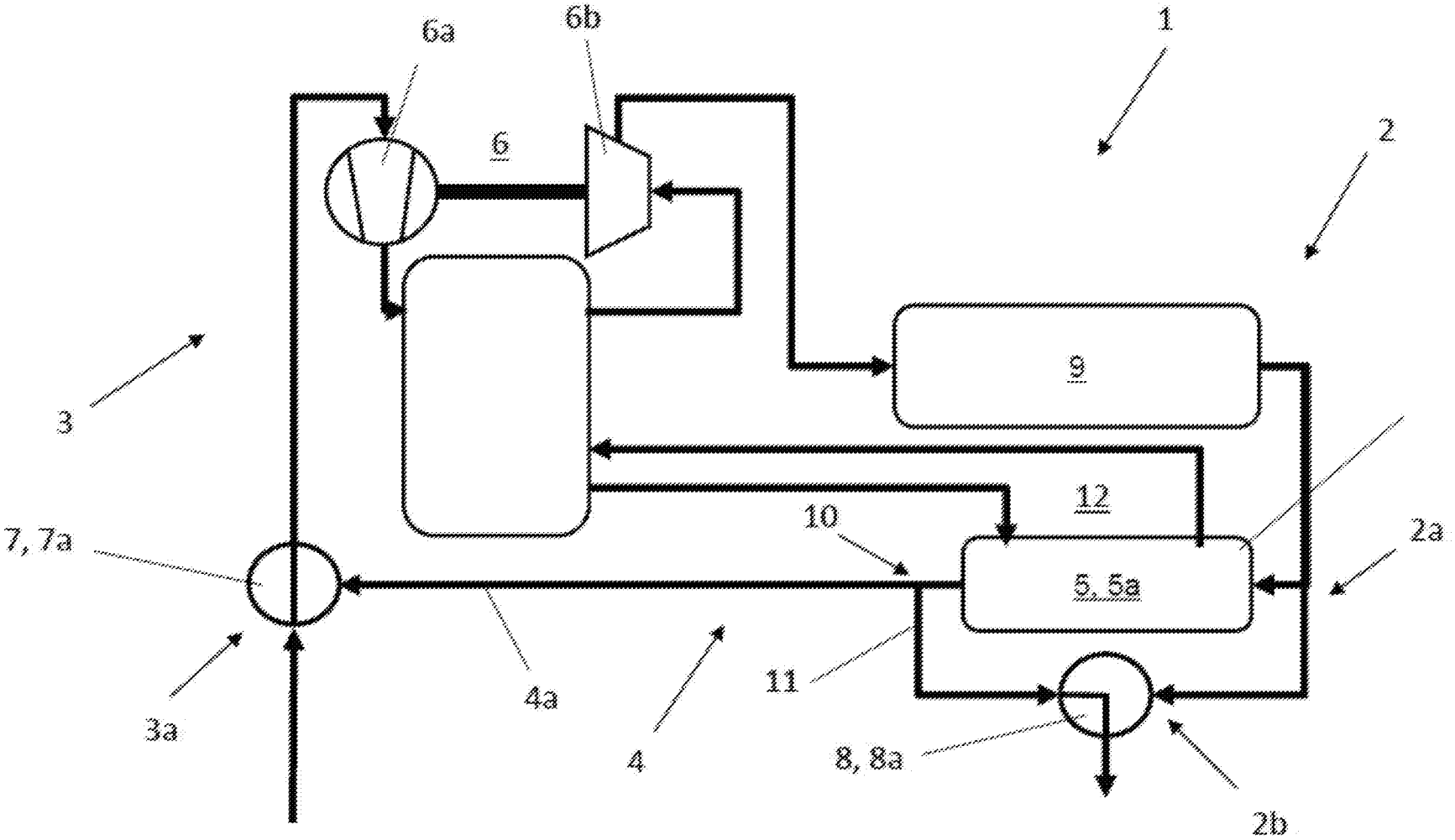
FIG. 3 schematically shows the first embodiment of the internal combustion engine together with exhaust-gas recirculation arrangement in a second operating mode.
Figure 4:
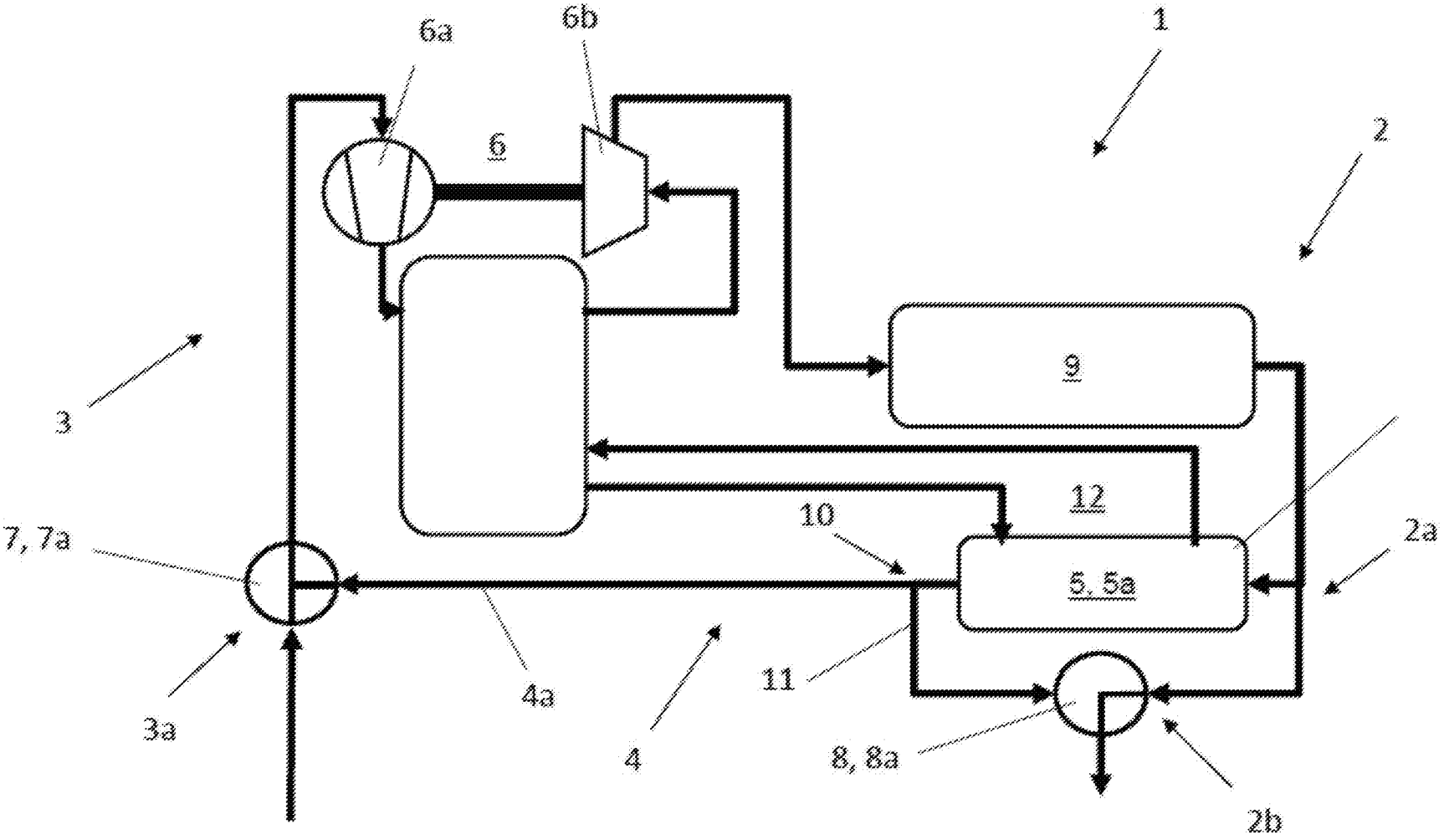
FIG. 4 schematically shows the first embodiment of the internal combustion engine together with exhaust-gas recirculation arrangement in a third operating mode.
Figure 5:
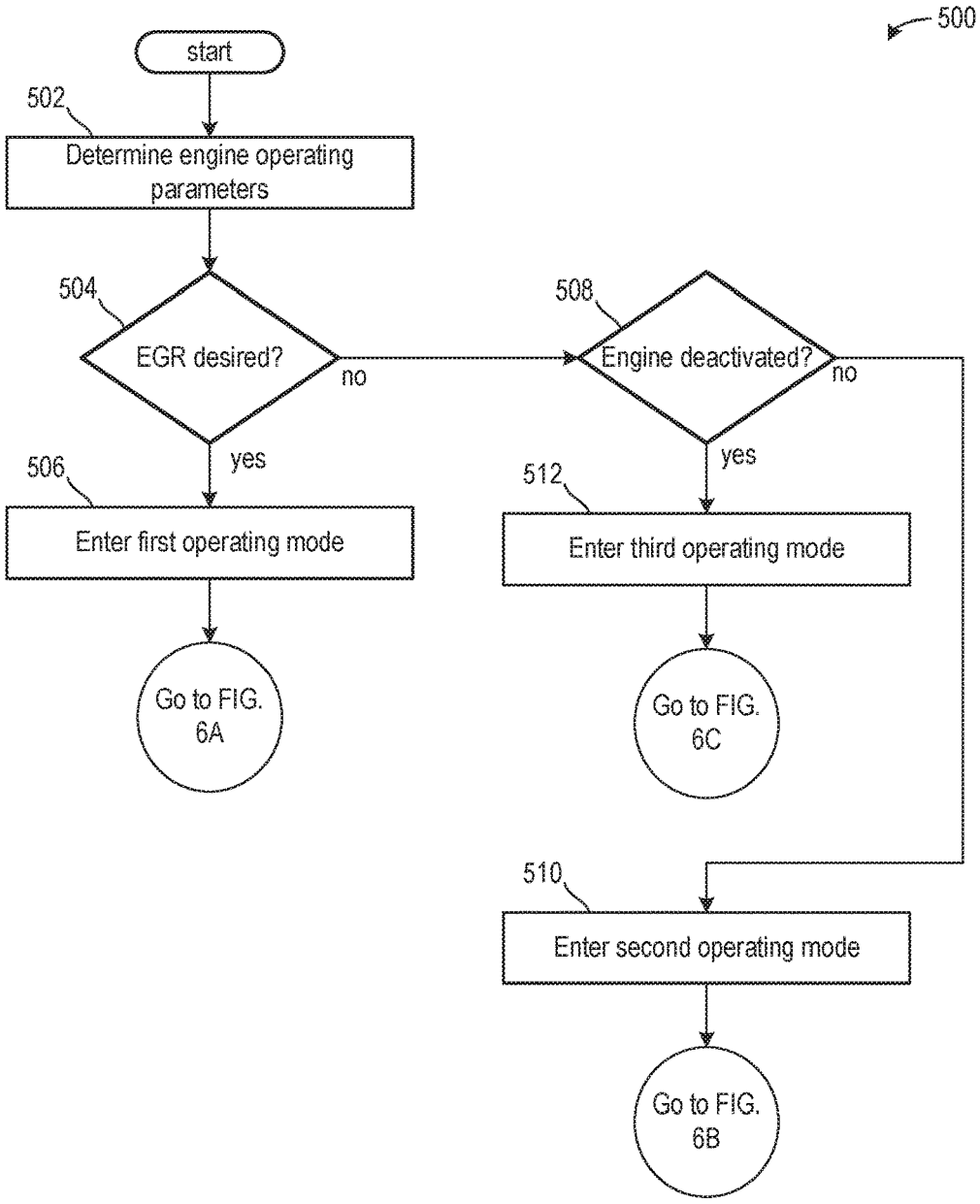
FIG. 5 shows a high-level flow chart for a method to select between the first, second, and third operating modes.
Figure 6A:
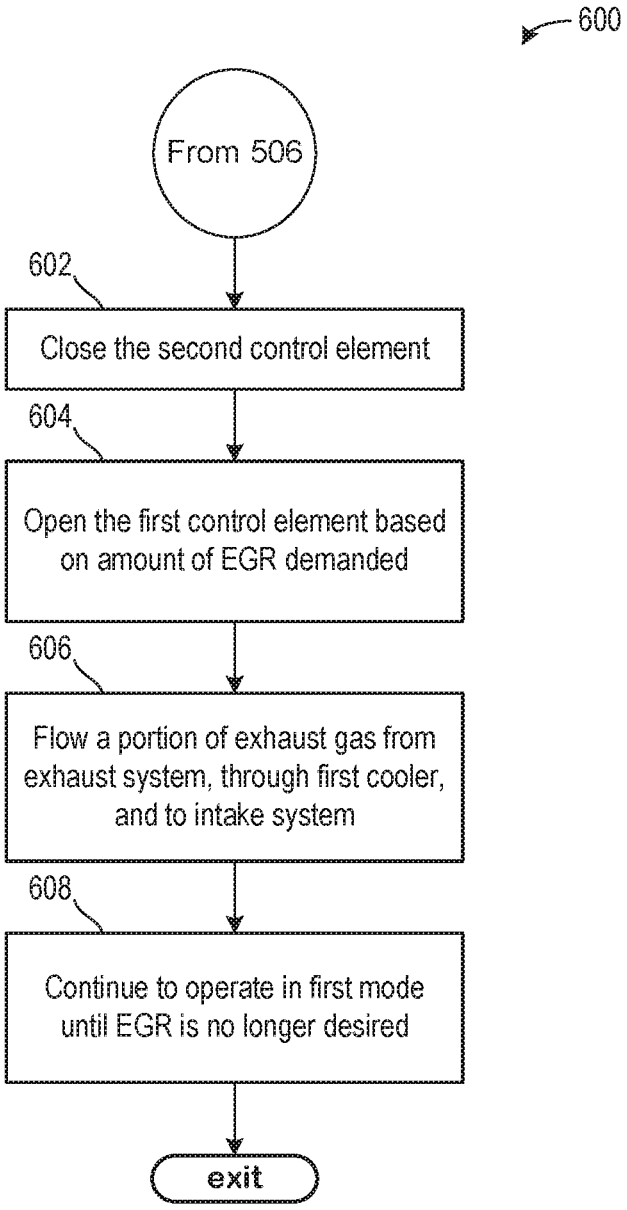
FIG. 6A shows a method for executing the first operating mode.
Figure 6B:
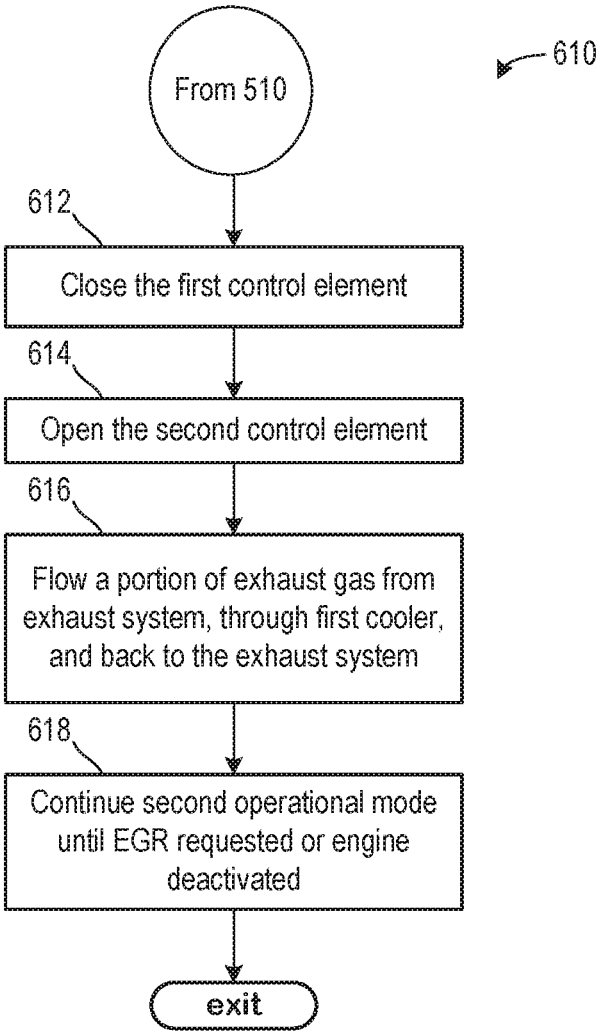
FIG. 6B shows a method for executing the second operating mode.
Figure 6C:
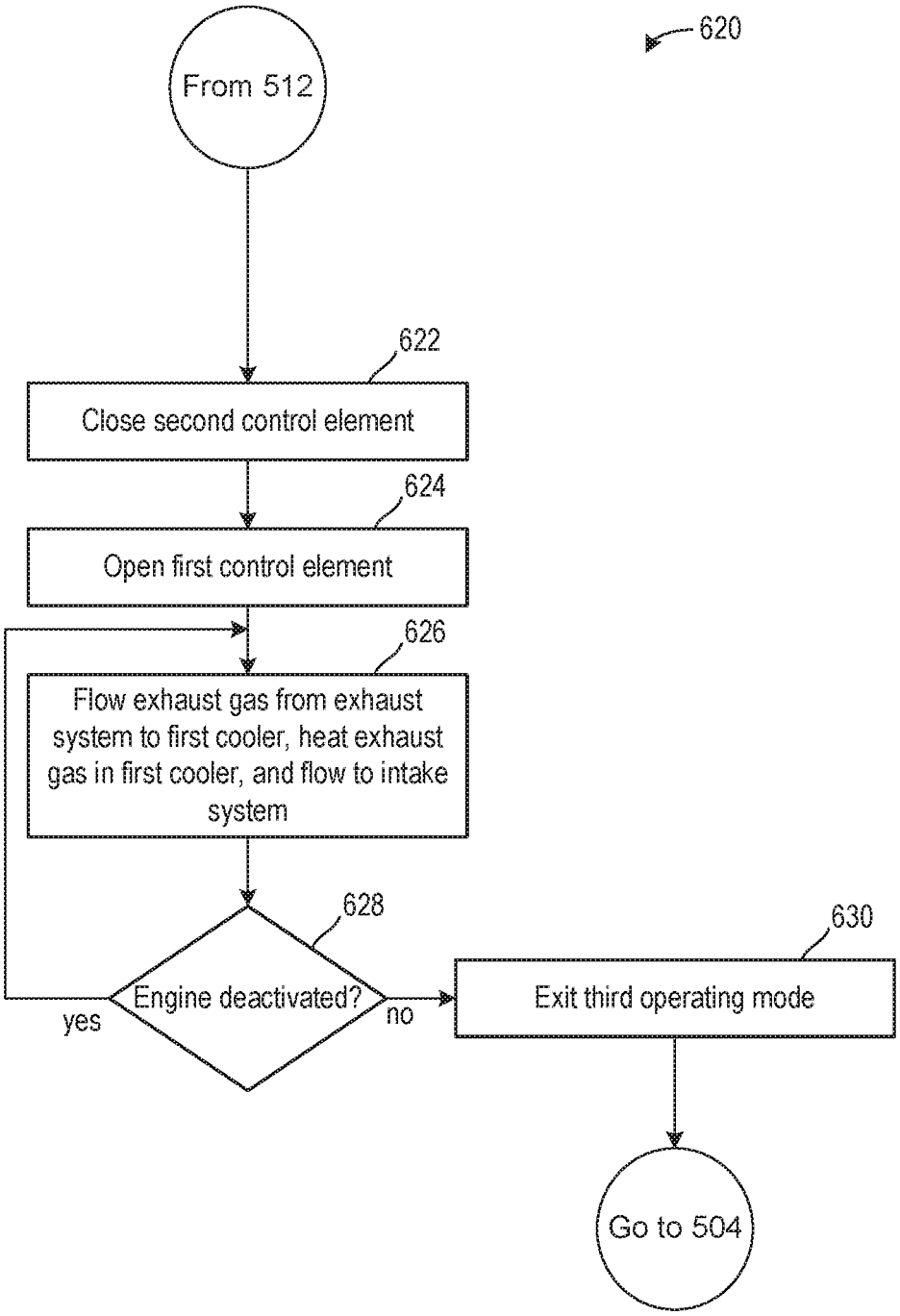
FIG. 6C shows a method for executing the third operating mode.
Figure 7:
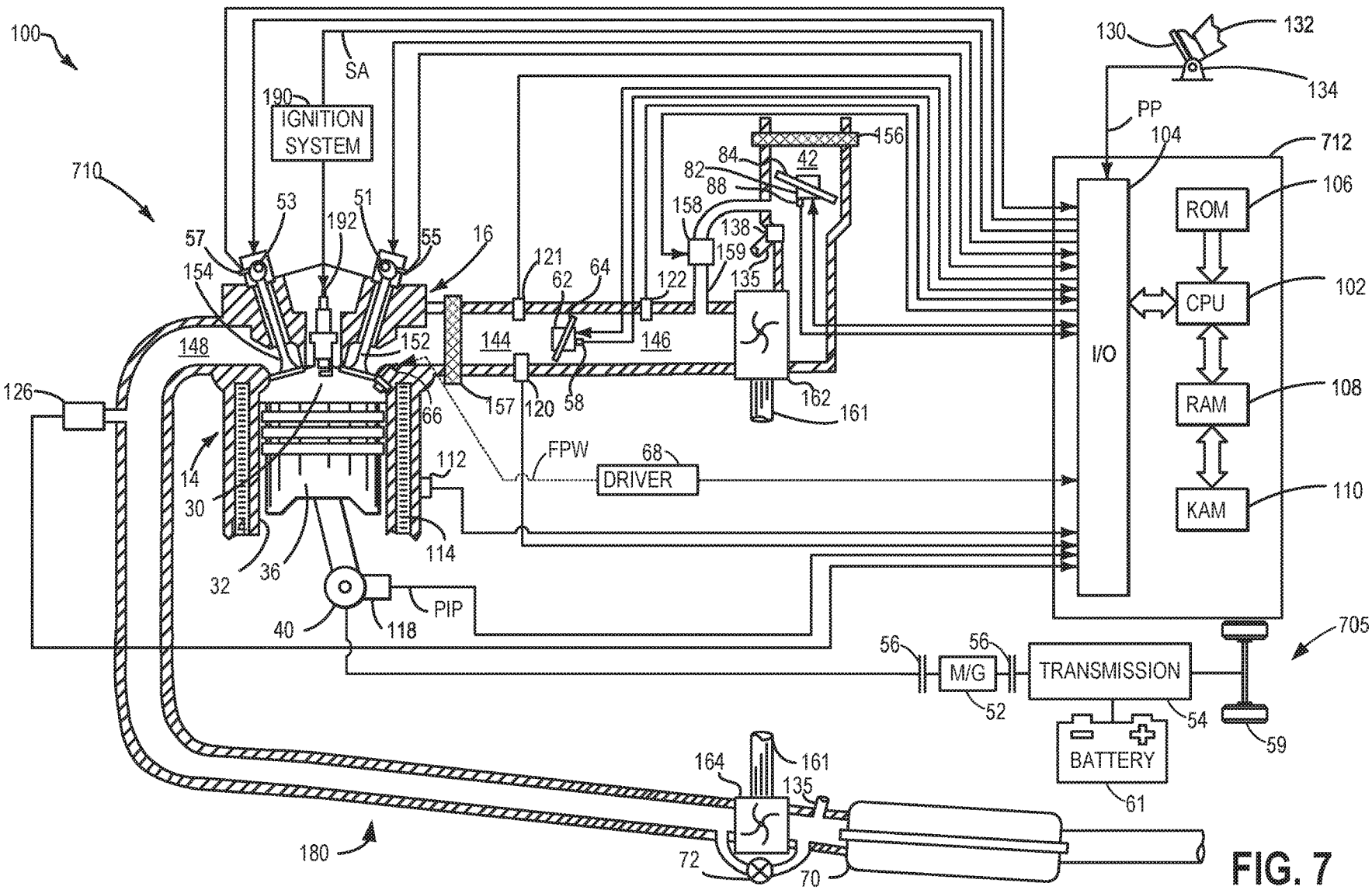
FIG. 7 shows a schematic for an engine of a hybrid vehicle.
Figure 8:
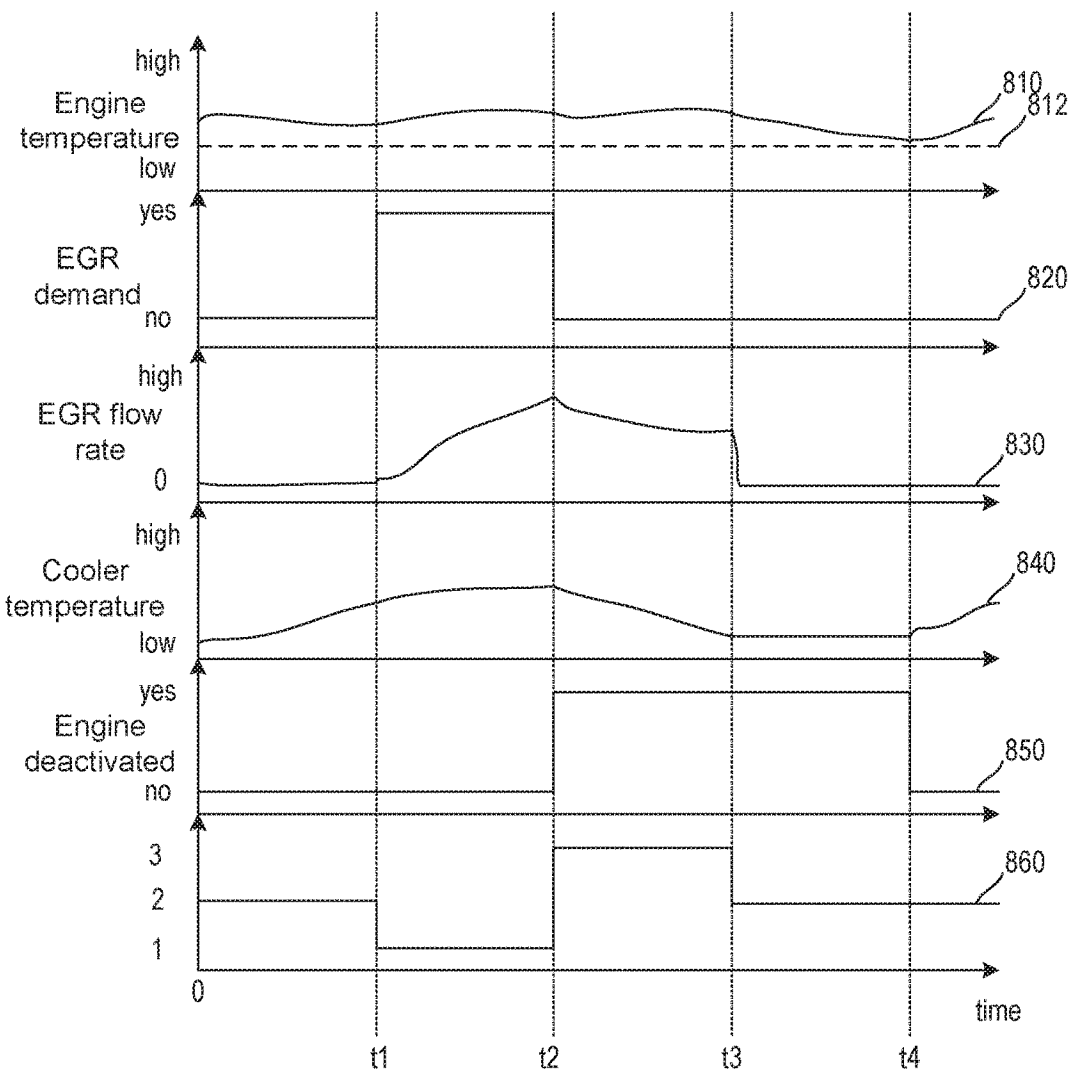
FIG. 8 shows an engine operating sequence illustrating the methods of FIGS. 6A, 6B, and 6C being executed in combination with the engine of FIGS. 1 and 7.

The following description relates to systems and methods for an EGR cooler comprising a phase-change material configured to heat and cool exhaust gas. FIG. 1 shows an embodiment of an internal combustion engine. FIG. 2 shows the internal combustion engine operating in a first mode. FIG. 3 shows the internal combustion engine operating in a second mode. FIG. 4 shows the internal combustion engine operating in a third mode. FIG. 5 shows a high-level flow chart for selecting between the first, second, and third operating modes. FIG. 6A shows a method for executing the first operating mode. FIG. 6B shows a method for executing the second operating mode. FIG. 6C shows a method for executing the third operating mode. FIG. 7 shows a schematic of an engine in a hybrid vehicle. The engine of FIG. 7 may be similar to the engine of FIG. 1. FIG. 8 shows an engine operating sequence including the methods of FIGS. 5, 6A, 6B, and 6C being executing in combination with the engines of FIGS. 1 and 7.

FIGS. 9A, 9B, 9C, 9D, and 9E show various operating modes for a second embodiment of the internal combustion engine, wherein the second embodiment comprises a first cooler and a second cooler. In one example, the first cooler may be a cooler dedicated to cooling EGR and the second cooler may be a cooler dedicated to heat recuperation. In some operating modes, the first and second coolers may operate in tandem to provide an increased amount of cooling to the EGR while simultaneously recuperating heat. Additionally or alternatively, both the first and second coolers may be used for heat recuperation.

FIGS. 1-4, 7, and 9A through 9E show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

As another example, the problems described above may be solved by an internal combustion engine having at least one cylinder, an intake system for supplying air to the at least one cylinder, an exhaust-gas discharge system for discharging the exhaust gases, and an exhaust-gas recirculation arrangement which comprises at least one recirculation line, with at least one cooler and at least one control element being provided in the at least one recirculation line for the purposes of setting a predefinable exhaust-gas flow rate for recirculation, and at least one cooler is equipped with a phase-change material, wherein the phase-change material is present either as a liquid phase or as a solid phase depending on the material temperature, and stores heat as the material temperature rises and emits stored heat again as the material temperature falls.

In the internal combustion engine according to the present disclosure, at least one cooler of the exhaust-gas recirculation system is equipped with a phase-change material, wherein several coolers may also be prepared with this material.

The phase-change material may extract heat from the hot exhaust gas conducted through the cooler, and thus serves as an additional heat sink but also as an energy store. In other words, the cooler equipped with the phase-change material according to the disclosure may extract more energy from the exhaust gas than a conventional cooler which uses only coolant. This offers advantages in the case of large exhaust-gas quantities which occur at high engine speeds or loads, and in particular at the high exhaust-gas temperatures which occur at high loads.

The cooler equipped with phase-change material according to the disclosure has a further significant advantage in comparison with conventional coolers. When desired, the phase-change material may return the stored energy, extracted from the exhaust gas, back to the exhaust gas. In this way, the cooler may function as a heater during some engine conditions where exhaust gas temperatures are lower than temperatures of the cooler.

An advantageous effect of this facility of the cooler is for example that it may mitigate the cooling down of the inoperative internal combustion engine in overrun mode and/or a fuel-cut off mode. The exhaust gas taken from the exhaust-gas discharge system is heated further on its passage through the cooler, and supplied to the cylinders of the inoperative internal combustion engine via the intake system, whereby cooling down is at least partially countered. On restart or re-firing of the internal combustion engine, the operating temperature is reached more quickly than usual, giving advantages in terms of efficiency and pollutant emissions. In some examples, the operating temperature may be maintained during the entire duration of the fuel-cut off mode.

Furthermore, advantages result when the internal combustion engine is switched off, for example when the vehicle is parked. When the internal combustion engine is started again, the internal combustion engine may be heated more quickly, in particular by the heating of the intake air using the recirculated exhaust gas, whereby again advantages are achieved in relation to efficiency and pollutant emissions.

This effect will become increasingly important since one concept for reducing fuel consumption consists of deactivating the internal combustion engine when there is no momentary power demand, instead of continuing operation on idle (start-stop strategy). This may include deactivating cylinders such that they are no longer fuelled.

A further application is stop-and-go traffic, such as is encountered for example in traffic jams on freeways and highways. In inner-city traffic, stop-and-go traffic is ubiquitous owing to the presence of non-intercoordinated traffic signals and the increased volume of traffic.

The exhaust-gas energy recovered using coolant in the cooler may be utilized for example in the warm-up phase or after a cold start, for warming the engine oil of the internal combustion engine and thus reducing the friction losses of the internal combustion engine. In the case of a liquid-cooled internal combustion engine, the exhaust-gas energy can be utilized for warming the coolant of the engine cooling arrangement and thus accelerating the heating of the internal combustion engine. Both measures improve or increase the efficiency of the internal combustion engine.

The at least one EGR cooler of the internal combustion engine according to the disclosure is configured both with regard to effective cooling and with regard to energy recovery, that is to say the utilization of the exhaust-gas energy. According to the disclosure, methods for both are described below.

The at least one recirculation line of the exhaust-gas recirculation system according to the disclosure may belong to a low-pressure EGR or to a high-pressure EGR.

Several coolers may be provided, for example arranged in parallel, which are switched on successively and used for cooling the exhaust gas to be recirculated. In this way, the cooling power of the EGR cooling arrangement, or the number of EGR coolers, can be adapted to the exhaust-gas flow rate for cooling. This has numerous advantageous effects which will be described below.

The pressure gradient across a single cooler changes during the operation of the cooler to a lesser extent, because the exhaust-gas flow rates to be cooled or managed by said cooler vary to a lesser extent.

In the case of relatively low recirculation rates, it is possible according to the disclosure for one cooler to be used for cooling the exhaust gas for recirculation. If the exhaust-gas flow rate for recirculation and for cooling then increases, it is possible, for example in the event of an exceedance of a threshold exhaust-gas flow rate, for a further cooler to be activated in order to cool exhaust gas and contribute to the cooling of the exhaust gas for recirculation. Depending on the number of EGR coolers provided, if for example three, four or more coolers are provided, activation can be performed several times or in succession. The control or adjustment of the recirculation rate reacts less dynamically.

Embodiments of the internal combustion engine may further comprise where the coolers form an integral structural unit. A prefabricated assembly which comprises the coolers and which constitutes the entire cooling unit simplifies the installation of the exhaust-gas recirculation arrangement and of the internal combustion engine as a whole, and thus also reduces costs.

Embodiments of the internal combustion engine may further comprise where the coolers are in the form of individual, separate coolers. In accordance with a modular principle, it is then possible using individual coolers to form different exhaust-gas recirculation arrangements or to equip different internal combustion engines.

Embodiments of the internal combustion engine may further comprise where a charging arrangement is provided.

A cooler according to the disclosure may comprise at least one cavity or at least one container for receiving the phase-change material. A cavity or container for receiving the phase-change material may be formed during the production process as an integral part of the cooler. The cooler may be structured in modular fashion, wherein a cavity for receiving the phase-change material is formed during assembly.

A cavity may be formed in that the cooler itself is provided with a casing, so that a cavity containing the phase-change material is formed between the cooler and the at least one casing element arranged spaced therefrom. The cooler extended by the casing then comprises the container for receiving the phase-change material.

Embodiments of the internal combustion engine may further comprise where the at least one cooler comprises at least one cavity for receiving the phase-change material. Embodiments of the internal combustion engine may further comprise where the at least one cavity is formed using at least one casing element.

The at least one cooler may not be a cast part in which the at least one cavity is formed as an integral constituent part during the course of the casting process. Rather, a cooler may be an assembled system, composed for example of sheet metal, in which the at least one cavity is formed during the assembly process using casing elements arranged spaced apart from one another.

Embodiments of the internal combustion engine may further comprise where the at least one cooler has, for the purposes of energy recovery, at least one coolant-conducting coolant jacket which serves for the transfer of heat between the exhaust gas and the coolant.

Embodiments of the internal combustion engine may further comprise where a first recirculation line is provided in which a first cooler is arranged and which, using at least one control element, is at least connectable upstream of the first cooler to the exhaust-gas discharge system and downstream of the first cooler to the intake system.

In this context, embodiments of the internal combustion engine may further comprise where the first recirculation line is at least connectable downstream of the first cooler selectively to the intake system and/or to the exhaust-gas discharge system using at least one control element.

In the case of the present embodiment, the exhaust-gas energy of the hot exhaust gas can be utilized even when the exhaust-gas recirculation arrangement has been deactivated, namely by means of the first cooler which is connectable downstream selectively to the intake system and/or to the exhaust-gas discharge system, wherein at least one control element serves for this purpose, by means of which the exhaust-gas-conducting lines can be switched accordingly, namely connected to the exhaust-gas discharge system.

It is thus possible, even when the exhaust-gas recirculation arrangement has been deactivated, for heat to be transferred from the exhaust gas to the coolant and phase-change material of the first cooler, wherein the coolant flowing through the first cooler discharges the heat from the interior of the first cooler and supplies it for a predefined duration, or the phase-change material stores the heat extracted from the exhaust gas, whereby the efficiency of the internal combustion engine is increased. In this respect, the exhaust-gas energy inherent in the exhaust gas can be utilized.

Embodiments of the internal combustion engine may further comprise where the first recirculation line branches off from the exhaust-gas discharge system so as to form a first junction point and opens into the intake system so as to form a second junction point.

In this context, embodiments of the internal combustion engine may further comprise where a first control element is provided in the first recirculation line at the second junction point.

The first control element functions as an EGR valve and, when the exhaust-gas recirculation arrangement is active, serves for the adjustment of the recirculation rate, i.e. the quantity of exhaust gas recirculated via the first recirculation line. The use of a combination valve arranged at the second junction point permits dimensioning of the recirculated exhaust-gas flow rate and at the same time throttling of the intake fresh-air flow rate.

A combination valve of said type may for example be a flap which is pivotable about an axis running transversely with respect to the fresh-air flow, in such a way that, in a first end position, the front side of the flap blocks the intake system, and at the same time the recirculation line is opened up, and, in a second end position, the back side of the flap covers the recirculation line, and at the same time the intake system is opened up. An additional valve body which is connected and thereby mechanically coupled to the flap either opens up or blocks the recirculation line. Whereas the flap serves for the adjustment of the air flow rate supplied via the intake system, the valve body effects the metering of the recirculated exhaust-gas flow rate.

Embodiments of the internal combustion engine may further comprise where an exhaust-gas-conducting line is provided which branches off from the first recirculation line downstream of the first cooler so as to form a third junction point and opens into the exhaust-gas discharge system so as to form a fourth junction point.

In this context, embodiments of the internal combustion engine may further comprise where a second control element is arranged at the fourth junction point. The second control element may be used to connect the first cooler downstream to the exhaust-gas discharge system. The first cooler may not cool any exhaust gas for recirculation. Rather, the first cooler cools exhaust gas which has been extracted from the exhaust-gas discharge system and is re-introduced into the exhaust-gas discharge system. That is to say, in the present case, the first cooler serves only for energy recovery (e.g., for making the energy inherent in the exhaust gas utilizable at a later time).

Embodiments of the internal combustion engine may further comprise where the second control element is a 3/3-way directional control valve which has three line connections and three switch positions.

Here, embodiments of the internal combustion engine may further comprise where the fourth junction point is arranged in the exhaust-gas discharge system downstream of the first junction point. In this embodiment, the exhaust-gas backpressure upstream of the fourth junction point, and hence also at the inlet to the exhaust-gas recirculation system, may be increased in a targeted fashion by adjusting the second control element towards the closed position.

This allows the propulsive pressure gradient across the cooler to be increased. A possibility of the exhaust gas escaping around the cooler, (e.g., bypassing the cooler), is now hindered.

To generate the desired pressure gradient, it is additionally possible for a shut-off element to be provided upstream of the point at which the exhaust-gas recirculation arrangement opens into the intake system, in order, at the inlet side, to reduce the pressure downstream of the shut-off element.

Embodiments of the internal combustion engine may further comprise where at least one compressor which can be driven by means of an auxiliary drive is arranged in the intake system.

The advantage of a compressor that can be driven by means of an auxiliary drive, that is to say a supercharger, in relation to an exhaust-gas turbocharger consists in that the supercharger can generate, and make available, the desired charge pressure during a greater number of conditions, and in some examples independent of the operating state of the internal combustion engine. This applies in particular to a supercharger which can be driven electrically via an electric machine, and is therefore independent of the rotational speed of the crankshaft.

In previous examples, it is specifically the case that difficulties are encountered in achieving an increase in power in all engine speed ranges via exhaust-gas turbocharging. A relatively severe torque drop is observed in the event of a certain engine speed being undershot. Said torque drop is understandable since the charge pressure ratio is dependent on the turbine pressure ratio or the turbine power. If the engine speed is reduced, this leads to a smaller exhaust-gas mass flow and therefore to a lower turbine pressure ratio or a lower turbine power. Consequently, toward lower engine speeds, the charge pressure ratio likewise decreases. This equates to a torque drop.

Embodiments of the internal combustion engine may further comprise where at least one exhaust-gas turbocharger is provided, which comprises a turbine arranged in the exhaust-gas discharge system and a compressor arranged in the intake system. In an exhaust-gas turbocharger, a compressor and a turbine are arranged on the same shaft. The hot exhaust-gas flow is fed to the turbine and expands in the turbine with a release of energy, as a result of which the shaft is set in rotation. The energy supplied by the exhaust-gas flow to the shaft is used for driving the compressor which is likewise arranged on the shaft. The compressor conveys and compresses the charge air fed to it, as a result of which supercharging of the cylinders is realized. A charge-air cooler is advantageously provided in the intake system downstream of the compressor, by means of which charge-air cooler the compressed charge air is cooled before it enters the at least one cylinder. The cooler lowers the temperature and thereby increases the density of the charge air, such that the cooler also contributes to improved charging of the cylinders, that is to say to a greater air mass. In effect, compression by cooling occurs.

The advantage of an exhaust-gas turbocharger in relation to a supercharger may comprise where an exhaust-gas turbocharger utilizes the exhaust-gas energy of the hot exhaust gases, whereas a supercharger draws the energy desired for driving it directly or indirectly from the internal combustion engine and thus adversely affects, that is to say reduces, the efficiency, at least for as long as the drive energy does not originate from an energy recovery source.

If the supercharger is not one that can be driven by means of an electric machine, that is to say electrically, a mechanical or kinematic connection for power transmission is generally demanded between the supercharger and the internal combustion engine, which also adversely affects or determines the packaging in the engine bay.

To be able to counteract a torque drop at low engine speeds, embodiments of the internal combustion engine may further comprise where at least two exhaust-gas turbochargers are provided. Specifically, if the engine speed is reduced, this leads to a smaller exhaust-gas mass flow and therefore to a lower charge-pressure ratio.

Through the use of multiple exhaust-gas turbochargers, for example multiple exhaust-gas turbochargers connected in series or parallel, the torque characteristic of a charged internal combustion engine may be improved.

In order to improve the torque characteristic, it is possible, in addition to the at least one exhaust-gas turbocharger, for a further compressor to also be provided, specifically either a supercharger that can be driven by means of an auxiliary drive or a compressor of a further exhaust-gas turbocharger.

In this context, embodiments of the charged internal combustion engine may further comprise where at least one recirculation line opens into the intake system downstream of the compressor.

In the case of a high-pressure EGR arrangement, the exhaust gas is introduced into the intake system downstream of the compressor. Here, to provide or ensure the pressure gradient desired for a recirculation, between the exhaust-gas discharge system and the intake system, in the case of an exhaust-gas turbocharging arrangement the exhaust gas is preferably, and commonly, extracted from the exhaust-gas discharge system upstream of the associated turbine. High-pressure EGR has the advantage that the exhaust gas does not pass through the compressor, and therefore does not have to be subjected to exhaust-gas aftertreatment, for example in a particle filter, before the recirculation. There is no risk of deposits in the compressor which change the geometry of the compressor, in particular the flow cross sections, and thereby impair the efficiency of the compressor. Condensate formation may occur downstream of the compressor, which also, during the course of the compression, heats the charge air that is supplied to it, and thereby prevents or counteracts condensate formation.

In this context, embodiments of the charged internal combustion engine may further comprise where at least one recirculation line opens into the intake system upstream of the compressor.

During the operation of an internal combustion engine with exhaust-gas turbocharging and the simultaneous use of a high-pressure EGR arrangement, a conflict may arise when the recirculated exhaust gas is extracted from the exhaust-gas discharge system upstream of the turbine and is no longer available for driving the turbine.

In the event of an increase in the exhaust-gas recirculation rate, the exhaust-gas flow introduced into the turbine simultaneously decreases. The reduced exhaust-gas mass flow through the turbine leads to a lower turbine pressure ratio, as a result of which the charge pressure ratio also falls, which equates to a smaller compressor mass flow. Aside from the decreasing charge pressure, problems may additionally arise in the operation of the compressor with regard to the surge limit. Disadvantages may also arise in terms of the pollutant emissions, for example with regard to the formation of soot during an acceleration in the case of diesel engines.

For this reason, concepts are desired which ensure adequately high charge pressures with simultaneously high exhaust-gas recirculation rates. One approach to a solution is low-pressure EGR, by means of which exhaust gas that has already flowed through the turbine is recirculated into the intake system. For this purpose, the low-pressure EGR arrangement extracts exhaust gas from the exhaust-gas discharge system downstream of the turbine and conducts said exhaust gas into the intake system preferably upstream of the compressor, in order to be able to realize the pressure gradient, desired for a recirculation, between the exhaust-gas discharge system and the intake system.

The exhaust gas which is recirculated via the low-pressure EGR arrangement is mixed with fresh air upstream of the compressor. The mixture of fresh air and recirculated exhaust gas produced in this way forms the charge air which is supplied to the compressor and compressed, wherein the compressed charge air is cooled, downstream of the compressor, in a charge-air cooler.

Since exhaust gas is conducted through the compressor, the exhaust gas may be subjected to exhaust-gas aftertreatment downstream of the turbine. The low-pressure EGR arrangement may also be combined with a high-pressure EGR arrangement.

For the reasons already stated, embodiments of the charged internal combustion engine may further comprise where at least one recirculation line branches off from the exhaust-gas discharge system upstream of the turbine.

Embodiments of the charged internal combustion engine may further comprise where the turbine of a provided exhaust-gas turbocharger has a variable turbine geometry, which permits an extensive adaptation to the operation of the internal combustion engine through adjustment of the turbine geometry or of the effective turbine cross-section. Here, adjustable guide blades for influencing the flow direction are arranged in the inlet region of the turbine. By contrast to the impeller blades of the rotating impeller, the guide blades do not rotate with the shaft of the turbine.

If the turbine has a fixed, invariable geometry, the guide blades may be arranged in the inlet region so as to be not only stationary but rather also completely immovable, that is to say rigidly fixed, if a guide device is provided at all. By contrast, in the case of a variable geometry, the guide blades are duly arranged so as to be stationary but not so as to be completely immovable, rather so as to be rotatable about their axis, such that the incident flow onto the impeller blades can be influenced.

Through adjustment of the turbine geometry, it is possible for the exhaust-gas pressure upstream of the turbine to be influenced, and thus for the pressure gradient between the exhaust-gas discharge system and intake system, and thus the recirculation rate of the high-pressure EGR arrangement, to be influenced.

For reasons already stated, embodiments of the charged internal combustion engine may further comprise where at least one recirculation line branches off from the exhaust-gas discharge system downstream of the turbine.

In this context, embodiments of the charged internal combustion engine may further comprise where at least one exhaust-gas aftertreatment system is provided in the exhaust-gas discharge system between the turbine and the at least one branching-off recirculation line. Since exhaust gas is conducted through the compressor, the exhaust gas is preferably subjected to exhaust-gas aftertreatment downstream of the turbine.

Here, embodiments of the internal combustion engine may further comprise where a particle filter is provided as exhaust-gas aftertreatment system for the aftertreatment of the exhaust gas.

To minimize the soot emission, use is in this case made of a regenerative particle filter which filters the soot particles out of the exhaust gas and stores them, with said soot particles being burned off intermittently during the course of the regeneration of the filter. The temperatures necessary to regenerate the particle filter when there is no catalytic support present, lie at around 550° C. Therefore, regularly, additional measures are used to guarantee a regeneration of the filter under all operating conditions.

The regeneration of the filter introduces heat into the exhaust gas and increases the exhaust-gas temperature and thus the exhaust-gas enthalpy. An energy-rich exhaust gas is thus available at the outlet of the filter, where the exhaust gas may be utilized in the manner according to the disclosure.

Embodiments of the charged internal combustion engine may further comprise where an oxidation catalytic converter is provided as exhaust-gas aftertreatment system for the aftertreatment of the exhaust gas.

Admittedly, given a sufficiently high temperature level and in the presence of sufficiently large oxygen quantities, oxidation of the unburned hydrocarbons and of carbon monoxide takes place in the exhaust-gas discharge system, even without additional measures. However, on account of the exhaust-gas temperature which falls quickly in the downstream direction, and the consequently rapidly decreasing rate of reaction, said reactions are quickly halted. Therefore, use is made of catalytic reactors which, using catalytic materials, ensure an oxidation even at low temperatures. If nitrogen oxides are additionally to be reduced, this may, in the case of the Otto-cycle engine, be achieved through the use of a three-way catalytic converter.

The oxidation is an exothermic reaction, wherein the heat that is released increases the temperature and thus the enthalpy of the exhaust gas. A more energy-rich exhaust gas is thus available at the outlet of the oxidation catalytic converter. In this respect, the provision of an oxidation catalytic converter is expedient and advantageous in particular also with regard to the utilization of the exhaust-gas energy according to the disclosure.

Embodiments of the internal combustion engine may further comprise where a bypass line for circumventing the at least one cooler is provided, which bypass line bypasses the EGR cooler and where the exhaust gas that is recirculated via the exhaust-gas recirculation arrangement can be introduced, circumventing the cooler, into the intake system.

It may be expedient to bypass the EGR cooling arrangement for example in order to prevent heat from additionally being introduced into the liquid-type cooling arrangement of the internal combustion engine. Such an approach is expedient if the liquid-type cooling arrangement of the internal combustion engine is already highly loaded, for example in full-load situations. If the exhaust-gas recirculation arrangement is utilized during the course of engine braking, it is likewise expedient for the hot exhaust gas to be recirculated without being cooled.

Embodiments of the internal combustion engine may further comprise where a liquid-type cooling arrangement is provided for forming an engine cooling arrangement.

Here, embodiments of the internal combustion engine may further comprise where the at least one cylinder head of the internal combustion engine is provided with at least one coolant jacket, which is integrated in the cylinder head, in order to form a liquid-type cooling arrangement.

A liquid-type cooling arrangement may be desired in the case of charged engines because the thermal loading of charged engines is considerably higher than that of conventional internal combustion engines. If the cylinder head has an integrated exhaust manifold, said cylinder head is thermally more highly loaded than a conventional cylinder head which is equipped with an external manifold. Increased demands are placed on the cooling arrangement.

In this context, embodiments of the internal combustion engine may further comprise where the liquid-type cooling arrangement has a cooling circuit which comprises at least one cooler of the exhaust-gas recirculation arrangement.

If the at least one EGR cooler is incorporated into the cooling circuit of the engine cooling arrangement, numerous components and assemblies desired to form a circuit may be provided only singularly, as these may be used both for the cooling circuit of the EGR cooler and also for that of the engine cooling arrangement, which leads to synergies and cost savings, but also entails a weight saving.

For example, it is desired for only one pump for conveying the coolant, and one container for storing the coolant, to be provided. The heat dissipated to the coolant from the internal combustion engine and from the EGR cooling arrangement can be extracted from the coolant in a common heat exchanger.

The exhaust-gas energy or exhaust-gas heat that is absorbed by the coolant in the EGR cooling arrangement can thus likewise be utilized more easily, for example for warming the internal combustion engine or the engine oil.

FIG. 1 schematically shows a first embodiment of the internal combustion engine 1 together with exhaust-gas recirculation arrangement 4.

The internal combustion engine 1 may comprise an intake system 3 for supplying charge air to the cylinders and has an exhaust-gas discharge system 2 for discharging the exhaust gases from the cylinders.

For the purposes of supercharging, the internal combustion engine 1 may be equipped with an exhaust-gas turbocharger 6 which comprises a turbine **6*b* arranged in the exhaust-gas discharge system 2 and a compressor 6*a* arranged in the intake system 3**.

Furthermore, an exhaust-gas recirculation arrangement 4 is provided, having a recirculation line **4*a* which branches off from the exhaust-gas discharge system 2 downstream of the turbine 6*b* so as to form a first junction point 2*a*, and which opens into the intake system 3 upstream of the compressor 6*a* so as to form a second junction point 3*a*. A first control element 7 is provided at the second junction point 3*a*. A combination valve 7*a* may be used as first control element 7, which combination valve serves for the adjustment of the recirculated quantity of exhaust gas, i.e. the recirculation rate, and thus also for the deactivation of the exhaust-gas recirculation arrangement 4**.

A cooler 5 is arranged in the first recirculation line **4*a*. The cooler 5 has a coolant-conducting coolant jacket which serves to transmit heat between the exhaust gas and the coolant and is or can be connected fluidically to the engine cooling system 12**. Using the coolant, the exhaust gas can be cooled and exhaust-gas energy may be recovered or used.

The first cooler 5 is equipped with a phase-change material **5*a*. The phase-change material 5*a* is present either as a liquid phase or as a solid phase depending on the momentary material temperature; it stores exhaust gas heat as the material temperature rises and emits this stored heat again to the exhaust gas flowing through the cooler 5** as the material temperature falls.

To this extent, in one operating mode, the phase-change material **5*a* can extract heat from the hot exhaust gas during cooling and function as an energy store; in another operating mode, it can return the stored energy to the exhaust gas during heating. The cooler 5 equipped with the phase-change material 5*a*** can extract more energy from the exhaust gas than conventional coolers, and in addition can introduce additional heat into the exhaust gas when desired.

A further exhaust-gas-conducting line 11 is provided which branches off from the first recirculation line 4*a* downstream of the first cooler 5 so as to form a third junction point 10, and opens into the exhaust-gas discharge system 2 so as to form a fourth junction point 2*b*.

In the present case, the fourth junction point 2*b* is arranged in the exhaust-gas discharge system 2 downstream of the first junction point 2*a*. A second control element 8 is arranged at the fourth junction point 2*b* and is configured as a 3/3-way directional control valve 8*a*, (e.g., it has three line connections and three switch positions), and connects the first recirculation line 4*a* to the exhaust-gas discharge system 2 downstream of the first cooler 5 via the further exhaust-gas-conducting line 11 and the fourth junction point 2*b*, or separates the further exhaust-gas-conducting line 11 from the exhaust-gas discharge system 2.

In individual cases, the second control element 8 may serve as a choke element for adjusting (e.g., increasing) the exhaust-gas pressure upstream in the exhaust-gas discharge system 2, whereby the propulsive pressure gradient across the first cooler 5 is also increased.

The first cooler 5 may thus be used for cooling exhaust gas for recirculation, but also for energy recovery when the exhaust-gas recirculation arrangement 4 has been deactivated. In one example of the first operating mode shown in FIG. 1, both control elements 7, 8 are set such that both exhaust gas to be recirculated is cooled and energy is recovered from the exhaust gas which is extracted from the exhaust-gas discharge system 2 at the first junction point 2*a* and re-introduced into the exhaust-gas discharge system 2 at the fourth junction point 2*b*. Further operating modes will be discussed in more detail below with respect to FIGS. 2, 3, and 4.

In some examples, of FIG. 1, a second cooler may be arranged downstream of the first cooler 5. The second cooler may be differentiated from the first cooler in that the second cooler may be dedicated to only cooling exhaust gas. As such, the second cooler may be free of PCM. Additionally or alternatively, the second cooler may be exactly identical to the first cooler 5.

Downstream may refer to a component arranged relative to another component such that the downstream component may receive a gas following the upstream component. As such, if the second cooler is arranged downstream of the first cooler, then the first cooler may receive exhaust gas before the second cooler.

In some embodiments, additionally or alternatively, there may be a third control element arranged between the first cooler 5 and the exhaust gas discharge system 2. The third control element may adjust a flow of exhaust gas from the exhaust gas discharge system 2 to the first cooler 5. In this way, during engine operating conditions where neither EGR or energy recuperation is desired, the third control element may be moved to a fully closed position to block exhaust gas from flow to the first cooler 5 and a remainder of passages downstream therefrom.

Turning now to FIG. 2, it schematically shows the first embodiment of the internal combustion engine 1 together with exhaust-gas recirculation arrangement 4 in another example of the first operating mode. It is sought merely to explain the additional features in relation to FIG. 1, for which reason reference is made otherwise to FIG. 1. The same reference signs have been used for the same parts and components.

In the first operating mode, the second control element 8 separates the further exhaust-gas-conducting line 11, and hence the first recirculation line 4*a* and the first cooler 5, from the exhaust gas discharge system 2. The first recirculation line 4*a* is however connected to the intake system 3. The first and second control elements 7, 8 are switched or set correspondingly. The first cooler 5 exclusively cools exhaust gas for recirculation such that exhaust gas flowing through the first cooler 5 is not returned to the exhaust gas discharge system 2.

In one example, the first operating mode may include one or more operating parameters that allow LP-EGR to flow from the exhaust gas discharge system 2 to the intake system 3. As such, the first control element 7 may be in at least a slightly open position to allow passage of LP-EGR from the first cooler 5 to the intake system 3. To ensure that sufficient cooling is provided to the LP-EGR, which may decrease emissions and condensate formation, exhaust gas leaving the first cooler 5 may not return to the exhaust gas discharge system 2. As such, second control element 8 may be in a fully closed position, thereby fluidly sealing the further exhaust-gas-conducting line 11 from the exhaust gas discharge system 2. In this way, exhaust gas flowing to the first cooler 5 during the first mode 5 is utilized as LP-EGR and may not return to the exhaust gas discharge system 2. In this way, the first mode 5 may operate as a LP-EGR cooling mode during engine operating parameters where the engine cylinders are being fuelled and may not function as a heat recuperating mode. In the examples of FIGS. 1 and 2, the first operating mode flows at least some exhaust gas to the intake system 3 as EGR, while the example of the first operating mode in FIG. 1 allows some of the exhaust gas exiting the first cooler 5 to return to the exhaust gas discharge system 2, the first operating mode shown in FIG. 2 does not.

Turning now to FIG. 3, it schematically shows the first embodiment of the internal combustion engine 1 together with exhaust-gas recirculation arrangement 4 in a second operating mode. It is sought merely to explain the additional features in relation to FIGS. 1 and 2, for which reason reference is made otherwise to FIGS. 1 and 2. The same reference signs have been used for the same parts and components.

In the second operating mode, the first control element 7 separates the first recirculation line 4*a* from the intake system 3. The second control element 8 connects the further exhaust-gas-conducting line 11—and hence the first recirculation line 4*a* and the first cooler 5—to the exhaust-gas discharge system 2. The first cooler 5 does not cool any exhaust gas for recirculation, but only exhaust gas which has been taken from the exhaust-gas discharge system 2 at the first junction point 2*a* and is re-introduced to the exhaust-gas discharge system 2 at the fourth junction point 2*b*. The first cooler 5 thus serves exclusively for energy recovery. The first and second control elements 7, 8 are switched or set correspondingly.

In one example, the second operating mode may include one or more operating parameters that prevent exhaust gas from flowing to the first cooler 5 to flow to the intake system 3. In one example, the second operating mode may be referred to as an energy recuperating mode. The second operating mode may be selected in response to LP-EGR not being desired in combination with the first cooler 5 being capable of capturing more heat from the exhaust gas. In one example, the first cooler 5 may be capable of capturing and/or storing more heat if a portion of a phase-change material (PCM) in the first cooler is still solid. As such, the PCM in the first cooler may capture heat from the exhaust gas, where the PCM may phase change to liquid. The exhaust gas, which is now cooled, may flow back to the exhaust gas discharge system 2 via the second control element being in an at least partially open position. The exhaust gas exiting the first cooler 5 may not flow to the intake system 3 due to the first control element 7 being commanded closed in response to a EGR demand being absent.

Turning now to FIG. 4, it schematically shows the first embodiment of the internal combustion engine 1 together with exhaust-gas recirculation arrangement 4 in a third operating mode. It is sought merely to explain the additional features in relation to FIG. 2, for which reason reference is made otherwise to FIG. 2. The same reference signs have been used for the same parts and components.

In the third operating mode, the first and second control elements 7, 8 are switched or set as shown in FIG. 2. The internal combustion engine 1 is deactivated, which may include the cylinders of the engine no longer being fuelled.

The energy stored in the phase-change material 5*a* of the cooler 5 is in this case introduced into the exhaust gas which has been taken from the exhaust-gas discharge system 2 via the recirculation line 4*a* and introduced into the intake system 3, in order to heat the exhaust gas additionally and prevent or delay a cooling down of the inoperative internal combustion engine 1.

The exhaust gas taken from the exhaust gas discharge system 2 is heated additionally on flowing through the cooler 5 and is supplied to the cylinders of the inoperative internal combustion engine 1 via the intake system 3, so that the operating temperature of the internal combustion engine 1 does not fall or falls less quickly.

Said another way, the third operating mode may be substantially similar to the first operating mode, except that the engine is not being fuelled. As such, the first control element 7 may be commanded open in response to an engine temperature falling below a desired threshold rather than in response to EGR being demanded. In this way, the first cooler 5 is utilized as a heating device, wherein the exhaust gas from the exhaust gas discharge system 2 enters the first cooler 5 and is heated via the PCM 5*a*. In one example, the exhaust gas during the third operating mode may be substantially intake air as fuel is not being combusted. Exhaust gas entering the first cooler may be redirected back to the exhaust gas discharge system 2 without flowing through the internal combustion engine 1. As such, the further exhaust-gas-conducting line 11 may be sealed from the exhaust gas discharge system 8 due to the second control element being in a closed position.

Turning now to FIG. 5, it shows a high level flow-chart for a method 500 for determining which of the first, second, and third operating modes to enter. Instructions for carrying out method 500 and the rest of the methods included herein may be executed by a controller based on instructions stored on a memory of the controller and in conjunction with signals received from sensors of the engine system, such as the sensors described below with reference to FIG. 7. The controller may employ engine actuators of the engine system to adjust engine operation, according to the methods described below.

The method 500 begins at 502, which may include determining, estimating, and/or measuring current engine operating parameters. Current engine operating parameters may include but are not limited to one or more of boost pressure, pedal position, engine temperature, engine speed, EGR flow rate, mass air flow, throttle position, and air/fuel ratio.

The method 500 may proceed to 504, which may include determining if EGR is desired. EGR may be desired during more open throttle positions where more oxygen and nitrogen are flowing to the engine. This may additionally correspond with more lean conditions, where the air/fuel ratio is greater than 1 such that there is an excess of air. In this way, the EGR may dilute the charge, thereby producing less nitrogen oxides.

If EGR is desired, then the method 500 may proceed to 506 which may include entering the first operating mode, described below with respect to FIG. 6A. If EGR is not desired, then the method 500 may proceed to 508 which may include determining if the engine is deactivated. The engine may be deactivated if the engine is not being fuelled. That is to say, injectors in the engine are no longer injecting fuel or some other fuel source to the engine when the engine is deactivated.

If the engine is not deactivated (e.g., combusting), then the method 500 may proceed to 510, which may include entering the second operating mode, described below with respect to FIG. 6B. If the engine is deactivated (e.g., not combusting), then the method 500 may proceed to 512, which may include entering the third operating mode, described below with respect to FIG. 6C.

Turning now to FIG. 6A, it shows a method 600 for operating the engine in the first operational mode. The method 600 begins at 602, which includes closing the second control element. As described above, the second control element (e.g., second element 8 of FIGS. 1-4) is arranged in the further exhaust-gas-conducting line and may adjust an amount of exhaust gas directed from the first cooler back to the exhaust system. By closing the second control element, the exhaust gas flow leaving the first cooler may not flow through the further exhaust-gas-conducting line and back to the exhaust system. As such, exhaust gas in the first cooler is utilized as EGR in the first operational mode.

The method 600 may proceed to 604, which may include opening the first control element. By opening the first control element, exhaust gas in the recirculation line (e.g., recirculation line 4*a* of FIGS. 1-4) may flow through the first control element and into the intake system. In one example, the opening of the first control element may be based on an amount of EGR demanded, wherein the first control element is moved to a more open position as more EGR is demanded. In this way, the first control element may be actuated from a fully closed position (e.g., 0% EGR flow) to a fully open position (e.g., 100% EGR flow) and any position therebetween.

The method 600 may proceed to 606, which may include flowing a portion of exhaust gas from the exhaust system, through the first cooler, through the recirculation line, and into the intake system. This may further include blocking exhaust gas from flowing from the recirculation line, through the further exhaust-gas-conducting line, and back into the exhaust system.

The method 600 may proceed to 608, which may include continuing to operating in the first mode until EGR is no longer desired. In response to EGR no longer being desired, the first control element may be closed and the second control element may be opened. As such, in some examples, the second operational mode may be entered.

Turning now to FIG. 6B, it shows a method 610 for operating the engine in the second operational mode. In some examples, the second operational mode may be a default mode wherein the second operational mode include flowing exhaust gas to the first cooler from the exhaust system and then flowing the exhaust gas from the first cooler back to the exhaust system to be expelled to an ambient atmosphere.

The method 610 begins at 612, which includes closing the first control element. By closing the first control element, exhaust gas may be blocked from flowing through the recirculation line to the intake system. As such, EGR flow may be blocked.

The method 610 may proceed to 614, which may include opening the second control element. As such, exhaust gas from the exhaust system may flow to the first cooler, wherein the exhaust gas in the first cooler may be directed through the further exhaust-gas-conducting line, and back into the exhaust system. As such, the second operational mode may be an energy recuperation mode.

The method 610 may proceed to 616, which may include flowing a portion of exhaust gas from the exhaust system, through the first cooler, through an open second control element, and back to the exhaust system. The first control element may be closed to block EGR flow.

The method 610 may proceed to 618, which may include continuing the second operational mode until EGR is requested or until the engine is deactivated. In some examples, the second operational mode may be terminated in response to the first cooler no longer being able to recuperate heat from the exhaust gas. That is to say, the second operational mode may be terminated in response to the PCM of the first cooler being completely changed to a heated phase (e.g., a liquid) such that it may no longer be heated by exhaust gas. In response, the second control element may be closed in addition to the first control element such that exhaust gas remains in the exhaust system.

In some examples, additionally or alternatively, there may be a third control element arranged between the exhaust system and the first cooler, wherein the third control element may adjust exhaust flow from the exhaust system to the first cooler. In such an example, the third control element may be moved to a closed position in response to the PCM no longer capable of being heated by exhaust gas.

Turning now to FIG. 6C, it shows a method 620 for operating the engine in the third operational mode. In some examples, such as the example of method 620, the third operational mode may be executed following deactivation of the engine. In this way, the engine temperature may be maintained at a desired temperature by heating gases in the exhaust system via PCM in the first cooler, as will be described below.

The method 620 may begin at 622, which may include closing the second control element, similar to 602 of method 600 of FIG. 6A. As such, exhaust gas from the first cooler may not flow through the further exhaust-gas-conducting line and back to the exhaust system.

The method 620 may proceed to 624, which may include opening the first control element. The first control element may be moved to a fully open position, unlike 604 of method 600, which is opened based on an EGR demand. By fully opening the first control element, all the exhaust gas in the first cooler may flow to the intake system to heat the engine components and exhaust aftertreatment devices downstream of the engine. Additionally, fully opening the first control element may allow all of the heat transferred to the exhaust gas from the first cooler to be utilized.

In some examples, additionally or alternatively, the first control element may be metered open so that it is partially opened and may be increasingly opened if desired. By partially opening the first control element, a controlled amount of heated exhaust gas may flow from the recirculation line to maintain a temperature of the engine. By doing this, the engine may not exceed an upper threshold temperature during its deactivation.

The method 620 may proceed to 626, which may include flowing exhaust gas from the exhaust system to the first cooler, heating the exhaust gas in the first cooler, flowing the exhaust gas through the recirculation line and through an at least partially opened first control element to the intake system. In this way, exhaust gas may be heated via heat recuperated from exhaust during engine combustion via a PCM material in the first cooler. By doing this, engine lubricant, coolants, and components may be maintained at a desired engine operating temperature such that a likelihood of degradation may be reduced and frictional losses may be mitigated.

The method 620 may proceed to 628, which may include determining if the engine is still deactivated. The engine may still be deactivated if it is still not receiving fuel. If the engine is still deactivated, then the method 620 may continue to heat exhaust gas via the first cooler and flow the heated exhaust gas to the deactivated engine. If the engine is no longer deactivated and is now receiving fuel and combusting, then the method 600 may proceed to 630 which may include exiting the third operational mode. In some examples, the third operating mode may be terminated and the second operating mode may be subsequently initiated.

In some examples, methods may additionally include adjusting operating of the first and second control elements in response to a prediction and/or an estimation of engine deactivation incoming. Engine deactivation may be incoming if one or more of a vehicle speed is being reduced and/or if an accelerator pedal is released. Additionally or alternatively, engine deactivation may be predicted based on feedback from a navigation system or other GPS device, wherein the prediction may be based on a route driven. Coasting may occur along portions of the route where a traffic light is far ahead, on a downhill, and along a highway. If the deactivation is predicted, then a method may include initiating the second operating mode to recuperate heat from the exhaust gas to the first cooler while not flowing EGR. This may allow the engine to remain hot and not be cooled by EGR, while recuperating more heat from exhaust gas to prepare for an engine deactivation. By doing this, the engine deactivation may be extended while maintaining engine temperatures, thereby decreasing emissions and increasing fuel economy.

In some examples, additionally or alternatively, methods may additionally include adjusting operation of the first and second control elements during the engine deactivation. The adjusting may occur in response to an engine temperature. For example, if the engine temperature is within a desired engine temperature range at the beginning of the engine deactivation, then the third operating mode may be delayed and the second operating mode may be maintained. Additionally or alternatively, if a third control element is arranged between the first cooler and the exhaust system, then the third control element may be closed to block exhaust gas from flowing to the first cooler and the intake system. In response to the engine temperature falling below the desired engine temperature range, then the third operating mode may be executed, wherein the first control element is opened and the second control element is closed and if the third control element is opened, if present. In this way, the exhaust gas flow to the first cooler during the deactivation may be adjusted in response to the engine temperature.

If the engine temperature increases back to a temperature within the desired engine temperature range and/or if the heat of the first cooler is consumed, then the third operating method may be disabled and exhaust gas is prevented from flowing to the engine.

Turning now to FIG. 7, it depicts an engine system 100 for a vehicle. The vehicle may be an on-road vehicle having drive wheels which contact a road surface. Engine system 100 includes engine 710 which comprises a plurality of cylinders. FIG. 7 describes one such cylinder or combustion chamber in detail. The various components of engine 710 may be controlled by electronic engine controller 712. The engine 710 may be used similarly to internal combustion engine 1 of FIGS. 1-4.

Engine 710 includes a cylinder block 14 including at least one cylinder bore 20, and a cylinder head 16 including intake valves 152 and exhaust valves 154. In other examples, the cylinder head 16 may include one or more intake ports and/or exhaust ports in examples where the engine 710 is configured as a two-stroke engine. The cylinder block 14 includes cylinder walls 32 with piston 36 positioned therein and connected to crankshaft 40. Thus, when coupled together, the cylinder head 16 and cylinder block 14 may form one or more combustion chambers. As such, the combustion chamber 30 volume is adjusted based on an oscillation of the piston 36. Combustion chamber 30 may also be referred to herein as cylinder 30. The combustion chamber 30 is shown communicating with intake manifold 144 and exhaust manifold 148 via respective intake valves 152 and exhaust valves 154. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57. Thus, when the valves 152 and 154 are closed, the combustion chamber 30 and cylinder bore 20 may be fluidly sealed, such that gases may not enter or leave the combustion chamber 30.

Combustion chamber 30 may be formed by the cylinder walls 32 of cylinder block 14, piston 36, and cylinder head 16. Cylinder block 14 may include the cylinder walls 32, piston 36, crankshaft 40, etc. Cylinder head 16 may include one or more fuel injectors such as fuel injector 66, one or more intake valves 152, and one or more exhaust valves such as exhaust valves 154. The cylinder head 16 may be coupled to the cylinder block 14 via fasteners, such as bolts and/or screws. In particular, when coupled, the cylinder block 14 and cylinder head 16 may be in sealing contact with one another via a gasket, and as such the cylinder block 14 and cylinder head 16 may seal the combustion chamber 30, such that gases may only flow into and/or out of the combustion chamber 30 via intake manifold 144 when intake valves 152 are opened, and/or via exhaust manifold 148 when exhaust valves 154 are opened. In some examples, only one intake valve and one exhaust valve may be included for each combustion chamber 30. However, in other examples, more than one intake valve and/or more than one exhaust valve may be included in each combustion chamber 30 of engine 710.

In some examples, each cylinder of engine 710 may include a spark plug 192 for initiating combustion. Ignition system 190 can provide an ignition spark to cylinder 14 via spark plug 192 in response to spark advance signal SA from controller 712, under select operating modes. However, in some embodiments, spark plug 192 may be omitted, such as where engine 710 may initiate combustion by auto-ignition or by injection of fuel as may be the case with some diesel engines.

Fuel injector 66 may be positioned to inject fuel directly into combustion chamber 30, which is known to those skilled in the art as direct injection. Fuel injector 66 delivers liquid fuel in proportion to the pulse width of signal FPW from controller 712. Fuel is delivered to fuel injector 66 by a fuel system (not shown) including a fuel tank, fuel pump, and fuel rail. Fuel injector 66 is supplied operating current from driver 68 which responds to controller 712. In some examples, the engine 710 may be a gasoline engine, and the fuel tank may include gasoline, which may be injected by injector 66 into the combustion chamber 30. However, in other examples, the engine 710 may be a diesel engine, and the fuel tank may include diesel fuel, which may be injected by injector 66 into the combustion chamber. Further, in such examples where the engine 710 is configured as a diesel engine, the engine 710 may include a glow plug to initiate combustion in the combustion chamber 30.

Intake manifold 144 is shown communicating with throttle 62 which adjusts a position of throttle plate 64 to control airflow to engine cylinder 30. This may include controlling airflow of boosted air from intake boost chamber 146. In some embodiments, throttle 62 may be omitted and airflow to the engine may be controlled via a single air intake system throttle (AIS throttle) 82 coupled to air intake passage 42 and located upstream of the intake boost chamber 146. In yet further examples, AIS throttle 82 may be omitted and airflow to the engine may be controlled with the throttle 62.

In some embodiments, engine 710 is configured to provide exhaust gas recirculation, or EGR. When included, EGR may be provided as high-pressure EGR and/or low-pressure EGR. In examples where the engine 710 includes low-pressure EGR, the low-pressure EGR may be provided via EGR passage 135 and EGR valve 138 to the engine air intake system at a position downstream of air intake system (AIS) throttle 82 and upstream of compressor 162 from a location in the exhaust system downstream of turbine 164. EGR may be drawn from the exhaust system to the intake air system when there is a pressure differential to drive the flow. A pressure differential can be created by partially closing AIS throttle 82. Throttle plate 84 controls pressure at the inlet to compressor 162. The AIS may be electrically controlled and its position may be adjusted based on optional position sensor 88. In one example, EGR passage 135 may be substantially similar to recirculation passage **4*a* of FIGS. 1-4. As such, EGR valve 138 may represent a third control element arranged upstream of the first cooler 5, between the exhaust passage and the first cooler 5. In this way, the EGR valve 138** may be shaped to adjust exhaust flow to the first cooler.

Ambient air is drawn into combustion chamber 30 via intake passage 42, which includes air filter 156. Thus, air first enters the intake passage 42 through air filter 156. Compressor 162 then draws air from air intake passage 42 to supply boost chamber 146 with compressed air via a compressor outlet tube (not shown in FIG. 7). In some examples, air intake passage 42 may include an air box (not shown) with a filter. In one example, compressor 162 may be a turbocharger, where power to the compressor 162 is drawn from the flow of exhaust gases through turbine 164. Specifically, exhaust gases may spin turbine 164 which is coupled to compressor 162 via shaft 161. A wastegate 72 allows exhaust gases to bypass turbine 164 so that boost pressure can be controlled under varying operating conditions. Wastegate 72 may be closed (or an opening of the wastegate may be decreased) in response to increased boost demand, such as during an operator pedal tip-in. By closing the wastegate, exhaust pressures upstream of the turbine can be increased, raising turbine speed and peak power output. This allows boost pressure to be raised. Additionally, the wastegate can be moved toward the closed position to maintain desired boost pressure when the compressor recirculation valve is partially open. In another example, wastegate 72 may be opened (or an opening of the wastegate may be increased) in response to decreased boost demand, such as during an operator pedal tip-out. By opening the wastegate, exhaust pressures can be reduced, reducing turbine speed and turbine power. This allows boost pressure to be lowered.

However, in alternate embodiments, the compressor 162 may be a supercharger, where power to the compressor 162 is drawn from the crankshaft 40. Thus, the compressor 162 may be coupled to the crankshaft 40 via a mechanical linkage such as a belt. As such, a portion of the rotational energy output by the crankshaft 40, may be transferred to the compressor 162 for powering the compressor 162.

Compressor recirculation valve 158 (CRV) may be provided in a compressor recirculation path 159 around compressor 162 so that air may move from the compressor outlet to the compressor inlet so as to reduce a pressure that may develop across compressor 162. A charge air cooler 157 may be positioned in boost chamber 146, downstream of compressor 162, for cooling the boosted aircharge delivered to the engine intake. However, in other examples as shown in FIG. 7, the charge air cooler 157 may be positioned downstream of the electronic throttle 62 in an intake manifold 144. In some examples, the charge air cooler 157 may be an air to air charge air cooler. However, in other examples, the charge air cooler 157 may be a liquid to air cooler.

In the depicted example, compressor recirculation path 159 is configured to recirculate cooled compressed air from upstream of charge air cooler 157 to the compressor inlet. In alternate examples, compressor recirculation path 159 may be configured to recirculate compressed air from downstream of the compressor and downstream of charge air cooler 157 to the compressor inlet. CRV 158 may be opened and closed via an electric signal from controller 712. CRV 158 may be configured as a three-state valve having a default semi-open position from which it can be moved to a fully-open position or a fully-closed position.

Universal Exhaust Gas Oxygen (UEGO) sensor 126 is shown coupled to exhaust manifold 148 upstream of emission control device 70. Alternatively, a two-state exhaust gas oxygen sensor may be substituted for UEGO sensor 126. Emission control device 70 may include multiple catalyst bricks, in one example. In another example, multiple emission control devices, each with multiple bricks, can be used. While the depicted example shows UEGO sensor 126 upstream of turbine 164, it will be appreciated that in alternate embodiments, UEGO sensor may be positioned in the exhaust manifold downstream of turbine 164 and upstream of emission control device 70. Additionally or alternatively, the emission control device 70 may comprise a diesel oxidation catalyst (DOC) and/or a diesel cold-start catalyst, a particulate filter, a three-way catalyst, a $NO_x$ trap, selective catalytic reduction device, and combinations thereof. In some examples, a sensor may be arranged upstream or downstream of the emission control device 70, wherein the sensor may be configured to diagnose a condition of the emission control device 70.

Controller 712 is shown in FIG. 7 as a microcomputer including: microprocessor unit 102, input/output ports 104, read-only memory 106, random access memory 108, keep alive memory 110, and a conventional data bus. Controller 12 is shown receiving various signals from sensors coupled to engine 710, in addition to those signals previously discussed, including: engine coolant temperature (ECT) from temperature sensor 112 coupled to cooling sleeve 114; a position sensor 134 coupled to an input device 130 for sensing input device pedal position (PP) adjusted by a vehicle operator 132; a knock sensor for determining ignition of end gases (not shown); a measurement of engine manifold pressure (MAP) from pressure sensor 121 coupled to intake manifold 144; a measurement of boost pressure from pressure sensor 122 coupled to boost chamber 146; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 712. In a preferred aspect of the present description, Hall effect sensor 118 produces a predetermined number of equally spaced pulses every revolution of the crankshaft from which engine speed (RPM) can be determined. The input device 130 may comprise an accelerator pedal and/or a brake pedal. As such, output from the position sensor 134 may be used to determine the position of the accelerator pedal and/or brake pedal of the input device 130, and therefore determine a desired engine torque. Thus, a desired engine torque as requested by the vehicle operator 132 may be estimated based on the pedal position of the input device 130.

In some examples, vehicle 705 may be a hybrid vehicle with multiple sources of torque available to one or more vehicle wheels 59. In other examples, vehicle 705 is a conventional vehicle with only an engine, or an electric vehicle with only electric machine(s). In the example shown, vehicle 705 includes engine 710 and an electric machine 52. Electric machine 52 may be a motor or a motor/generator. Crankshaft 40 of engine 710 and electric machine 52 are connected via a transmission 54 to vehicle wheels 59 when one or more clutches 56 are engaged. In the depicted example, a first clutch 56 is provided between crankshaft 40 and electric machine 52, and a second clutch 56 is provided between electric machine 52 and transmission 54. Controller 712 may send a signal to an actuator of each clutch 56 to engage or disengage the clutch, so as to connect or disconnect crankshaft 40 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 59. Electric machine 52 may also be operated as a generator to provide electrical power to charge battery 58, for example during a braking operation.

The controller 712 receives signals from the various sensors of FIG. 7 and employs the various actuators of FIG. 7 to adjust engine operation based on the received signals and instructions stored on a memory of the controller. For example, adjusting operation of the first, second, and third control elements may be in response to an engine temperature, engine fuelling, or other condition.

Turning now to FIG. 8, it shows an engine operating sequence 800 illustrating the methods of FIGS. 5, 6A, 6B, and 6C being executed in response to a variety of engine operating conditions. The engine operating sequence includes plot 810 illustrating an engine temperature and dashed line 812 representing a lower end of a desired engine operating temperature range, plot 820 illustrating an EGR demand, plot 830 illustrating an EGR flow rate, plot 840 illustrating a first cooler temperature, plot 850 illustrating if an engine is deactivated, and plot 860 illustrating which of a first, a second, and a third operating mode is being executed. Time increases from a left to right side of the figure.

Prior to t1, the engine temperature (plot 810) is above the lower end of the desired engine operating temperature range (dashed line 812). EGR is not demanded (plot 820) and as such, the EGR flow rate is relatively low (plot 830). In the example of FIG. 8, the EGR flow rate is 0 when EGR is not demanded. The engine is not deactivated (plot 850). As a result, the second operating mode is selected (plot 860) and the first control element is closed and the second control element is at least partially opened, thereby allowing at least some exhaust gas to flow from the exhaust system, to the first cooler, and back to the exhaust system. As such, the first cooler temperature increases (plot 850).

At t1, EGR is demanded and the engine operating mode switches from the second operating mode to the first operating mode. Between t1 and t2, the engine temperature may remain above the lower end of the desired engine operating temperature range. The EGR flow rate may begin to increase toward a higher EGR flow rate. As such, the second control element may be adjusted to a closed position and the first control element may be adjusted to an at least partially open position to allow EGR to flow from the recirculation line to the intake system. The cooler temperature continues to increase as the exhaust gas flows through the cooler and to the intake system.

In one example, the first operating mode and the second operating mode may be further differentiated via a coolant flow to the first cooler. During the first operating mode, each of the PCM and coolant may cool the exhaust gas such that coolant does flow to the first cooler during the first operating mode. However, during the second operating mode, since cooling is not desired, coolant flow to the first cooler may be blocked so that exhaust gas flowing to the cooler may be cooled via only the PCM. As such, the PCM may recuperate more heat during the second operating mode than the first operating mode due to the absence of coolant in the first cooler. In this way, a temperature rise of the first cooler may be lower during the first operating mode than in the second operating mode.

At t2, the EGR demand is absent and the engine is deactivated. The first operating mode is terminated and the third operating mode is activated. Between t2 and t3, the EGR demand remains absent, however, the EGR flow rate remains between a high and low flow rate. In one example, the EGR flow rate between t2 and t3 is less than the flow rate between t1 and t2, which may be a result of the first control element moving to a more closed position relative to its position between t1 and t2. This may be to elongate a duration of time in which the engine may receive heated exhaust gas. Additionally, a composition of the EGR during the engine deactivation between t2 and t3 may be different than a composition of EGR during engine combustion between t1 and t2. In one example, the composition during the engine deactivation may comprise less carbon containing compounds. The engine temperature may remain above the lower end of the desired engine operating temperature range as the EGR is heated by the cooler before it flows to the intake system. As such, the cooler temperature may decrease during the engine deactivation as heat is transferred from the PCM to the EGR.

At t3, the engine remains deactivated. The cooler temperature is equal to a relatively low temperature and may no longer be able to heat EGR. As such, the third operating mode is deactivated and the second operating mode may be activated. Between t3 and t4, the deactivation continues and the engine temperature begins to decrease as the EGR flow rate is reduced to zero due to the first cooler no longer comprises heat to transfer to exhaust gas.

At t4, the engine is no longer deactivated. EGR is not demanded and as a result, the second operating mode is maintained. After t4, the engine temperature begins to increase and the second operating mode flows hot exhaust gas to the first cooler, wherein the cooler temperature begins to increase as heat from the exhaust gas is transferred to the PCM.

A second embodiment of the internal combustion engine shown in FIGS. 1-4 is described below with respect to FIGS. 9A through 9E. The second embodiment may comprise first control element which may function as an EGR valve and, when the exhaust-gas recirculation arrangement is active, serves for the adjustment of the recirculation rate, or at least of the exhaust-gas flow rate recirculated via the first recirculation line. The use of a combination valve arranged at the second junction point permits dimensioning of the recirculated exhaust-gas flow rate and at the same time throttling of the intake fresh-air flow rate.

A combination valve may for example be a flap which is pivotable about an axis running transversely with respect to the fresh-air flow, in such a way that, in a first end position, the front side of the flap blocks the intake system, and at the same time the recirculation line is opened up, and, in a second end position, the back side of the flap covers the recirculation line, and at the same time the intake system is opened up. An additional valve body which is connected and thereby mechanically coupled to the flap either opens up or blocks the recirculation line. Whereas the flap serves for the adjustment of the air flow rate supplied via the intake system, the valve body effects the metering of the recirculated exhaust-gas flow rate.

The second embodiment of the internal combustion engine may further comprise where the second recirculation line branches off from the exhaust-gas discharge system so as to form a third junction point and opens into the intake system so as to form a fourth junction point.

However, in the above-described context, in particular, embodiments of the internal combustion engine may further comprise where the second recirculation line branches off from the exhaust-gas discharge system so as to form a third junction point and opens into the first recirculation line downstream of the first cooler so as to form a fourth junction point.

Then, when the exhaust-gas recirculation arrangement is active, a control element provided at the second junction point can serve for adjusting the entire recirculation rate, specifically both the exhaust-gas flow rate recirculated by the first recirculation line and the exhaust-gas flow rate recirculated by the second recirculation line.

Here, the second embodiment of the internal combustion engine may further comprise where a second control element is provided in the second recirculation line downstream of the second cooler.

This second control element can be a control element switchable in two stages and can serve, that is to say can be used, to connect or separate the second cooler to and from the first recirculation line.

Consequently, the second control element can also be used to connect the second cooler downstream to the exhaust-gas recirculation system and to introduce the exhaust gas passed through the second cooler into the exhaust-gas recirculation system, for which purpose it may be necessary to provide further exhaust-gas-conducting lines. The second cooler then may not cool any exhaust gas for recirculation. Rather, the second cooler cools exhaust gas which has been extracted from the exhaust-gas discharge system and which is introduced into the exhaust-gas discharge system again. That is to say, in the present case, the second cooler serves only for energy recovery, that is to say for making the energy inherent in the exhaust gas utilizable.

For the reasons stated above, the second embodiment of the internal combustion engine may further comprise where a further exhaust-gas-conducting line is provided which branches off from the second recirculation line between the second cooler and the second control element so as to form a fifth junction point and opens into the exhaust-gas discharge system so as to form a sixth junction point.

In the second embodiment where the second recirculation line opens into the first recirculation line downstream of the first cooler so as to form a fourth junction point, it may then also be possible for the first cooler to be connected, downstream, to the exhaust-gas discharge system via the further exhaust-gas-conducting line. Then, the first cooler does not cool any exhaust gas for recirculation, but rather cools exhaust gas that is introduced into the exhaust-gas discharge system again. Then, both coolers serve for energy recovery when the exhaust-gas recirculation arrangement has been deactivated.

In the second embodiment in which an exhaust-gas-conducting line branches off from the second recirculation line downstream of the second cooler and opens into the exhaust-gas discharge system so as to form a sixth junction point, it is advantageous for the sixth junction point to be arranged in the exhaust-gas discharge system downstream of the first and third junction points.

In this context, the second embodiment of the internal combustion engine may further comprise where a third control element is arranged at the sixth junction point. The third control element can preferably be used to shut off and open the further exhaust-gas-conducting line or to shut off and open the gas discharge system upstream of the sixth junction point. Using the third control element, the further exhaust-gas-conducting line can be connected to the exhaust-gas discharge system downstream and upstream of the coolers. The exhaust-gas quantity introduced into the exhaust-gas discharge system via the further exhaust-gas-conducting line can be controlled using the third control element.

The third control element can also serve as a continuously variable throttle element for increasing the exhaust-gas pressure upstream in the exhaust-gas discharge system, whereby the driving pressure gradients across the coolers are likewise increased and a path for the exhaust gas to circumvent the coolers is eliminated, or the bypassing of the coolers is impeded.

To generate the desired pressure gradient, it is additionally possible for a shut-off element to be provided upstream of the point at which the exhaust-gas recirculation arrangement opens into the intake system, in order, at the inlet side, to reduce the pressure downstream of the shut-off element.

Figure 9A:
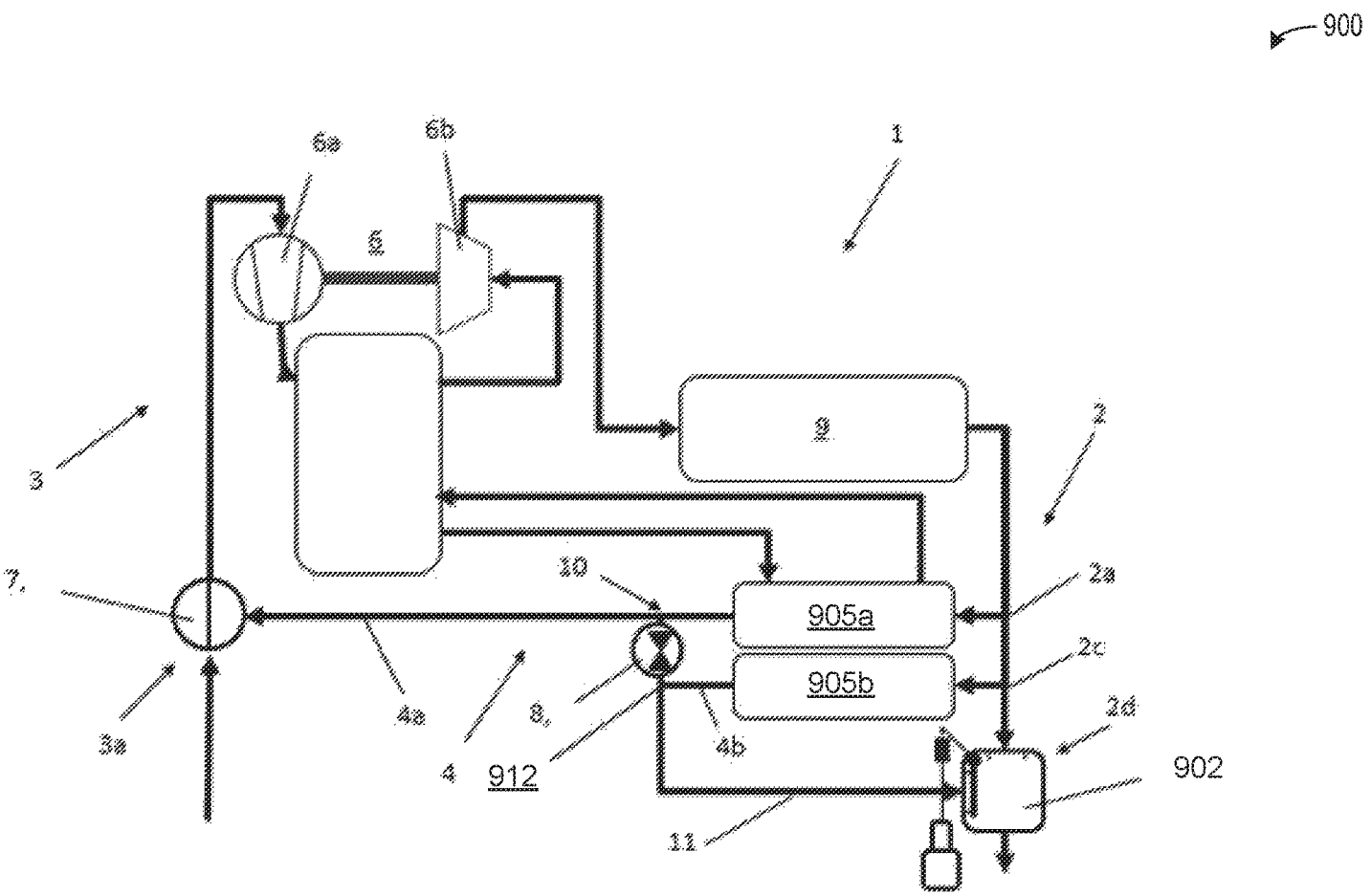
FIGS. 9A, 9B, 9C, 9D, and 9E show various operating modes for a second embodiment of the internal combustion engine, wherein the second embodiment comprises a first cooler and a second cooler.

Turning now to FIG. 9A, it schematically shows a first embodiment of the internal combustion engine 1 together with exhaust-gas recirculation arrangement 4 in a first operating mode. As such, components previously introduced may be similarly numbered in FIG. 9A and subsequent figures.

The internal combustion engine 1 has an intake system 3 for supplying charge air to the cylinders and has an exhaust-gas discharge system 2 for discharging the exhaust gases from the cylinders.

For the purposes of supercharging, the internal combustion engine 1 is equipped with an exhaust-gas turbocharger 6 which comprises a turbine 6*b* arranged in the exhaust-gas discharge system 2 and a compressor 6*a* arranged in the intake system 3.

Furthermore, an exhaust-gas recirculation arrangement 4 is provided which has two recirculation lines, namely the first recirculation line 4*a* and a second recirculation line 4*b*, wherein a first cooler 905*a* and a second cooler 905*b* are arranged in each of the first and second recirculation lines 4*a*, 4*b*, respectively. The first and second coolers 905*a*, 905*b* may comprise in each case one coolant-conducting coolant jacket which serves for the transfer of heat between the exhaust gas and the coolant. The first and second coolers 905*a*, 905*b* may be arranged in parallel and may be mutually independently usable for the cooling of exhaust gas or for energy recovery and fluidically connected or connectable to the engine cooling arrangement. In some examples, additionally or alternatively, one of the first and second coolers 905*a*, 905*b* may dedicated to only cooling EGR while the other cooler may both cool EGR and recuperate heat from exhaust gas.

The first recirculation line 4*a* branches off from the exhaust-gas discharge system 2 downstream of the turbine 6*b* so as to form a first junction point 2*a*, and opens into the intake system 3 upstream of the compressor 6*a* so as to form a second junction point 3*a*. A first control element 7 is provided at the second junction point 3*a*. A combination valve 7*a* is used as first control element 7, which combination valve serves for the adjustment of the recirculated exhaust-gas flow rate, that is to say of the recirculation rate, and thus also for the deactivation of the exhaust-gas recirculation arrangement 4.

The second recirculation line 4*b* likewise branches off from the exhaust-gas discharge system 2 downstream of the turbine 6*b* and downstream of the first junction point 2*a* so as to form a third junction point 2*c* and opens into the first recirculation line 4*a* downstream of the first cooler 905*a* so as to form a fourth junction point 10.

A further exhaust-gas-conducting line 11 is provided which branches off from the second recirculation line 4*b* downstream of the second cooler 905*b* so as to form a fifth junction point 912 and opens into the exhaust-gas discharge system 2 so as to form a sixth junction point 2*d*.

In the present case, the sixth junction point 2*d* is arranged in the exhaust-gas discharge system 2 downstream of the first and third junction points 2*a*, 2*c*. A third control element 902 is arranged at the sixth junction point 2*d*. The third control element 902 may be a continuously variable flap and, in the first operating mode of the second embodiment, serves to shut off the further exhaust-gas-conducting line 11. That is to say, the flap may be moved to a position where gases in the further exhaust-gas-conducting line 11 may be blocked from flowing to the exhaust gas discharge system 2.

A second control element 8 is provided in the second recirculation line 4*b*, downstream of the second cooler 905*b* and downstream of the fifth junction point 912. The second control element 8 may a 2/2-way valve which can be switched in two-stage fashion, has two line connectors and two switching positions and connects the two coolers 905*a*, 905*b* via the second junction point 3*a* to the intake system 3 or via the sixth junction point 2*d* to the exhaust-gas discharge system 2, or else deactivates the second cooler 905*b*, that is to say separates said second cooler from the first recirculation line 4*a* and connects said second cooler to the exhaust-gas discharge system 2 via the sixth junction point 2*d*.

Both coolers 905*a*, 905*b* can thus be used for cooling exhaust gas for recirculation but also for energy recovery when the exhaust-gas recirculation arrangement has been deactivated. This will be discussed in more detail below on the basis of FIGS. 9B to 9E.

In the first operating mode of the second embodiment 900 shown in FIG. 9A, the second control element 8 is in an at least partially open position and the first control element 7 seals the first recirculation line 4*a* from the intake system 3. The exhaust-gas recirculation arrangement 4 is thus deactivated. Owing to the shut-off exhaust-gas-conducting line 11 via the third control element 902 blocking the further exhaust-gas-conducting line 11, there may also be no energy recovery using the EGR-coolers 905*a*, 905*b*. In this way, exhaust gas may remain in the exhaust gas discharge system without flowing to the first and second EGR cooler 905*a*, 905*b* when the second embodiment 900 is in the first operating mode.

Figure 9B:
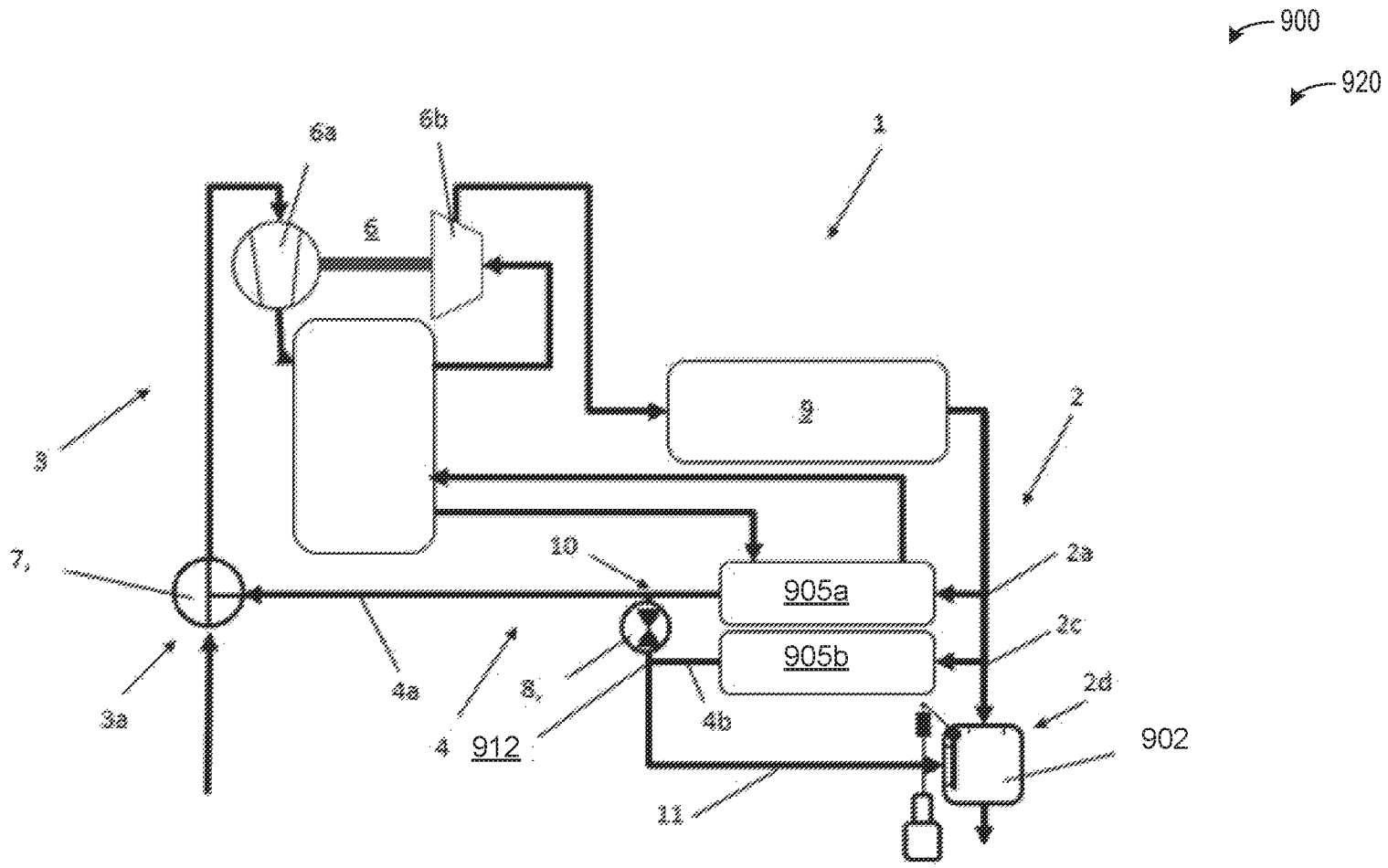

Turning now to FIG. 9B, it schematically shows the second embodiment 900 of the internal combustion engine 1 together with exhaust-gas recirculation arrangement 4 in a second operating mode 920. It is sought merely to explain the additional features in relation to FIG. 9A, for which reason reference is made otherwise to FIG. 9A. The same reference signs have been used for the same parts and components.

In the second operating mode 920, both first and second coolers 905*a*, 905*b* cool exhaust gas for recirculation. The second recirculation line 4*b* is connected to the first recirculation line 4*a*, and the first recirculation line 4*a* is connected to the intake system 3. The first control element 7 is switched or set to an at least partially open position to flow exhaust gas from the first recirculation line to the intake system 3. The second control element 8 is furthermore in an at least partially open position, and the further exhaust-gas-conducting line 11 continues to be shut off via the third control element 902 remaining in a position sealing the further exhaust-gas conducting line 11 from the exhaust gas discharge system 2.

Particularly if the internal combustion engine has been or is operated at relatively high loads and the coolant or first and second coolers 905*a*, 905*b* have heated up, it can be desired to recirculate exhaust gas through both coolers 905*a*, 905*b*. The heated coolers 905*a*, 905*b* and the hot coolant then cool the exhaust gas to a lesser extent. In some circumstances, the heated coolers 905*a*, 905*b* and the hot coolant even introduce heat into the exhaust gas. The high-temperature exhaust gas is recirculated into the cylinders, thereby raising the temperature within the cylinders and reducing friction losses.

Figure 9C:
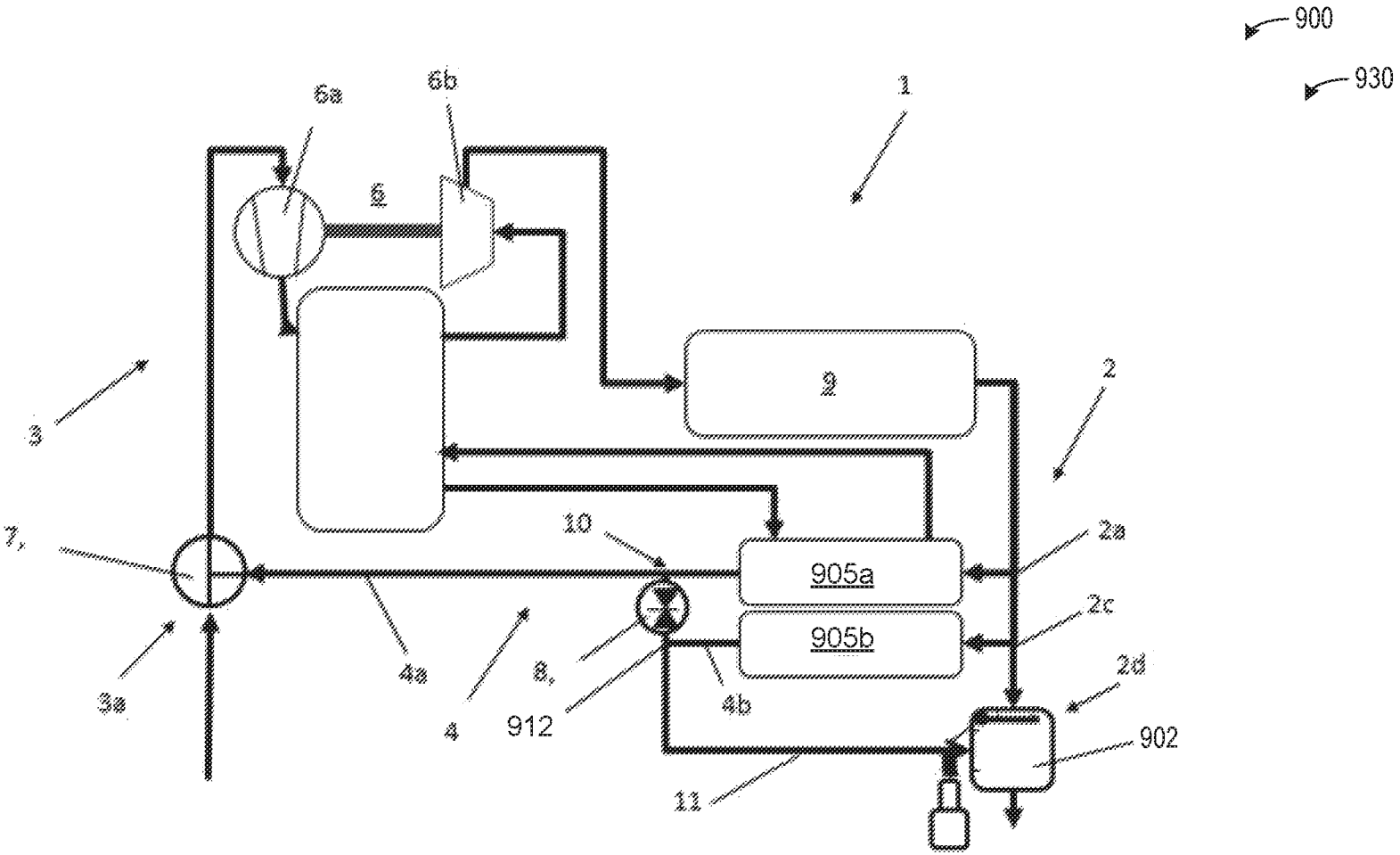

Turning now to FIG. 9C, it schematically shows the second embodiment 900 of the internal combustion engine 1 together with exhaust-gas recirculation arrangement 4 in a third operating mode 930. It is sought merely to explain the additional features in relation to FIGS. 9A and/or 9B, for which reason reference is made otherwise to FIGS. 9A and/or 9B. The same reference signs have been used for the same parts and components.

In the third operating mode 930, only the first cooler 905*a* cools exhaust gas for recirculation, for which purpose the first recirculation line 4*a* is connected to the intake system 3 via the second junction point 3*a*. The second recirculation line 4*b* together with the second cooler 905*b* is separated and/or sealed from the first recirculation line 4*a* and is connected to the exhaust-gas discharge system 2 via exhaust-gas-conducting line 11 and the sixth junction point 2*d*. The second cooler 905*b* thus serves for energy recovery. The first control element 7 connects the first recirculation line 4*a* to the intake system 3, and the second control element 8 is in the closed position and separates the second recirculation line 4*b* from the first recirculation line 4*a*. The third control element 902 opens the further exhaust-gas-conducting line 11 in the third operating mode 930.

In one example, during the third operating mode 930 of the second embodiment 900 of the internal combustion engine 1, the second cooler 905*b* may not receive a coolant flow. As such, a phase-change material (PCM) arranged in the second cooler 905*b* may be store all heat recuperated from exhaust gas flowing therethrough. In this way, the first cooler 905*a* may be the only cooler providing a cooling effect to EGR while the second cooler 905*b* provides a cooling effect to exhaust gas that does not flow to the intake system 1, but to an ambient atmosphere.

Figure 9D:
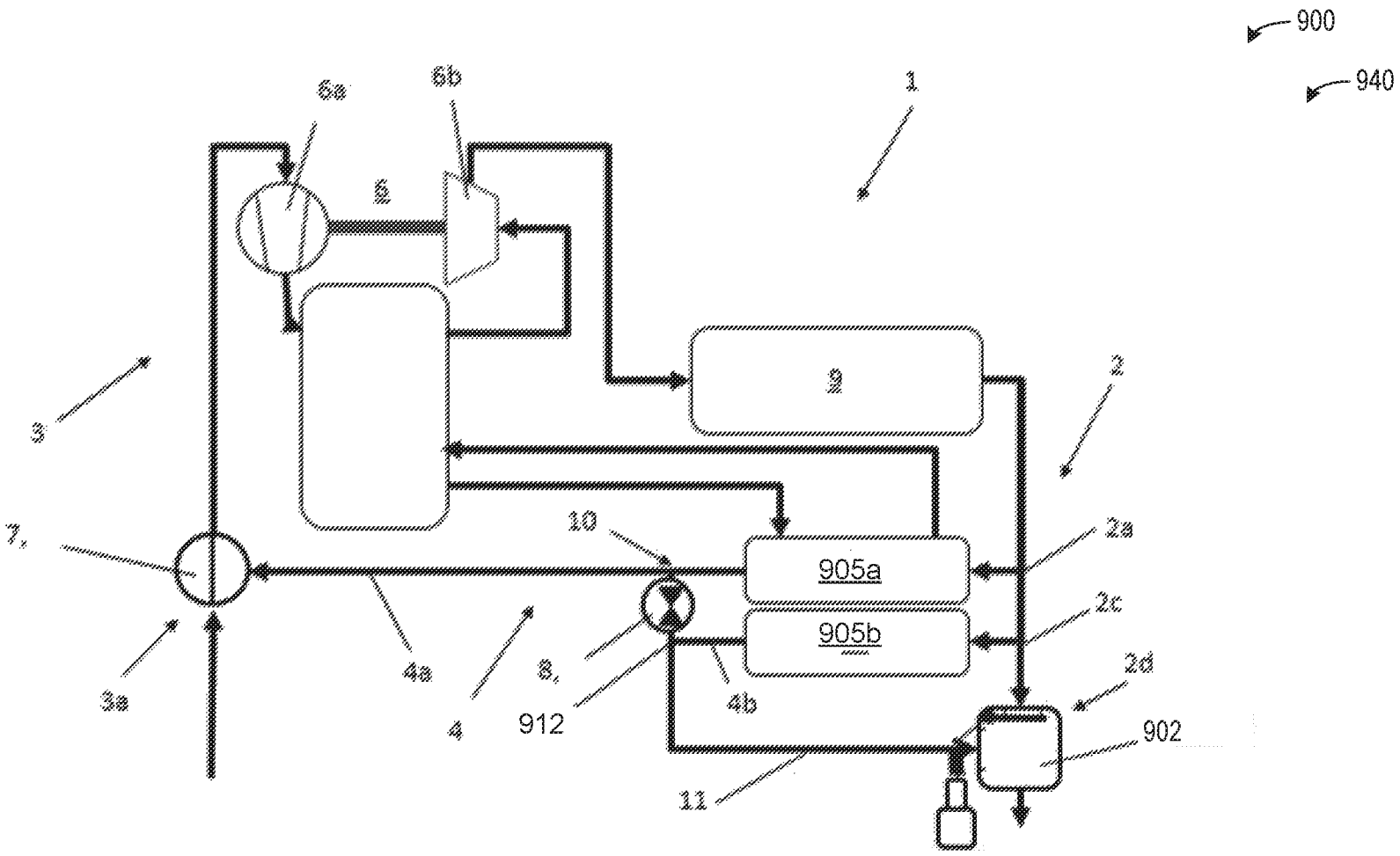

Turning now to FIG. 9D, it schematically shows the second embodiment 900 of the internal combustion engine 1 together with exhaust-gas recirculation arrangement 4 in a fourth operating mode 940. It is sought merely to explain the additional features in relation to the above FIGS. 9A, 9B and/or 9C, for which reason reference is made otherwise to FIGS. 9A, 9B and 9C. The same reference signs have been used for the same parts and components.

In the fourth operating mode 940, the exhaust-gas recirculation arrangement 4 has been deactivated, and both first and second coolers 905*a*, 905*b* are, with the exhaust-gas recirculation arrangement 4 deactivated, used for energy recovery. The first and second control elements 7, 8 are switched or set correspondingly such that the first control element 7 is closed and seals the first recirculation line 4*a* from the intake system and the second control element 8 is at least partially open and fluidly couples the first recirculation line 4*a* to the second recirculation line 4*b*. Both coolers 905*a*, 905*b* are connected to the exhaust-gas discharge system 2 via the sixth junction point 2*d* and separated from the intake system 3.

The first control element 7 separates the first recirculation line 4*a* from the intake system 3, and the second control element 8 is in the open position and connects the two recirculation lines 4*a*, 4*b*. The third control element 902 opens the further exhaust-gas-conducting line 11 in the fourth operating mode 940. In this way, PCM in each of the first and second cooler 905*a*, 905*b* may recuperate energy from the exhaust gas. This may occur in response to one or more of EGR not being desired, an engine fuel cut-off event upcoming, and the first and second coolers 905*a*, 905*b* being able to recuperate more exhaust heat.

Figure 9E:
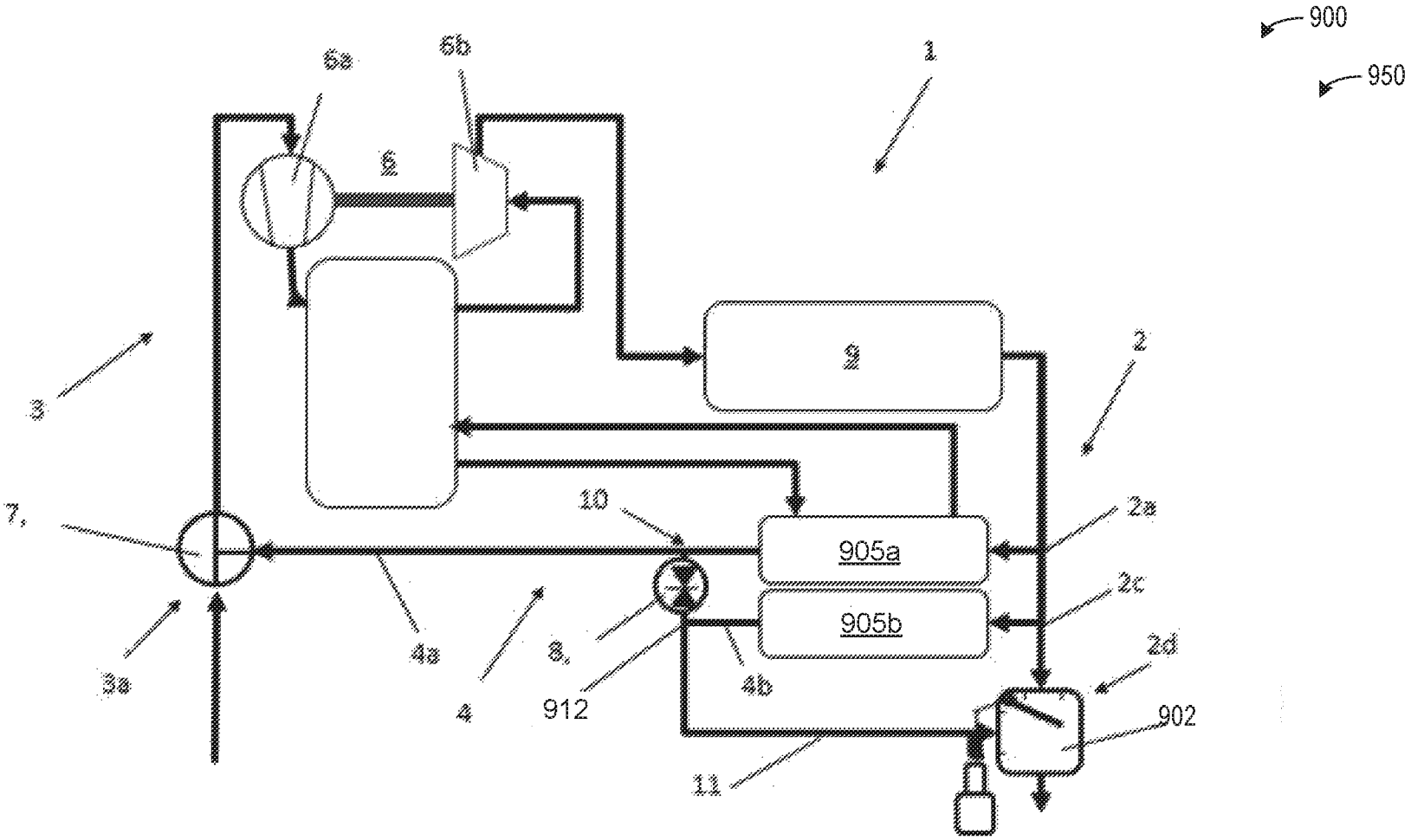

Turning now to FIG. 9E, it schematically shows the second embodiment 900 of the internal combustion engine 1 together with exhaust-gas recirculation arrangement 4 in a fifth operating mode 950. It is sought merely to explain the additional features in relation to FIG. 9C, for which reason reference is made otherwise to FIG. 9C. The same reference signs have been used for the same parts and components.

The first cooler 905*a* cools exhaust gas for recirculation in the fifth operating mode 950. For this purpose, the first control element 7 connects the first recirculation line 4*a* to the intake system 3.

The second recirculation line 4*b* together with the second cooler 5*b* is separated from the first recirculation line 4*a* and is connected to the exhaust-gas discharge system 2 via exhaust-gas-conducting line 11 and the sixth junction point 2*d*. The second cooler 905*b* thus serves for energy recovery. For this purpose, the second control element 8 is in the closed position and separates the second recirculation line 4*b* from the first recirculation line 4*a*.

In the fifth operating mode 950, the third control element 902 opens both the further exhaust-gas-conducting line 11 and the exhaust-gas discharge system 2 upstream of the sixth junction point 2*d*. The latter measure allows for high exhaust-gas flow rates, which can occur at high loads or high engine speeds and at which the pivotable flap acts as a pressure relief valve and opens the exhaust-gas discharge system 2 in order to avoid an excessive exhaust-gas backpressure. This pressure relief function can also be triggered in other operating modes and is achieved in a passive self-controlling manner via a spring in the second embodiment illustrated in the figures. Thus, the fifth operating mode 950 may function as an energy recuperation mode when EGR is desired and when exhaust gas flow rate is above a threshold flow rate, such that if the third control element 902 were to divert all exhaust gas to the first and second coolers 905*a*, 905*b*, then exhaust gas backpressure would exceed a threshold pressure and engine operation may become less efficient. As such, to relieve the backpressure while still recuperating exhaust heat, the third control element 902 is moved to an intermediate position, between the positions shown in FIGS. 9A and 9C.

In one example, the second embodiment of the internal combustion engine comprises a system comprising a first cooler arranged along a first recirculation line and a second cooler arranged along a second recirculation line. A first control element adjusting exhaust gas flow from the first recirculation line to an intake system. A second control element adjust exhaust gas flow from the first recirculation line to the second recirculation line. A third control element comprising a pivotable flap element shaped to adjust exhaust gas flow from the second recirculation line to an exhaust gas system. Each of the first and second cooler may be shaped to cool and recuperate heat from exhaust gas flowing therethrough. Additionally or alternatively, only of the coolers may be shaped to recuperate heat while the other may be shaped to only cool EGR as such one cooler may receive coolant and the other may comprise the phase-change material.

In this way, an EGR cooler may be equipped with a phase-change material shaped to receive and transfer heat with an exhaust gas during one or more engine operating conditions. A series of valves may be used to adjust engine operating modes to adjust EGR and heat transfer to the EGR cooler. The technical effect of equipping the EGR cooler with the phase-change material is to maintain an engine temperature during non-combusting engine events. By doing this, emissions may be reduced.

An embodiment of an internal combustion engine having at least one cylinder, an intake system for supplying air to the at least one cylinder, an exhaust-gas discharge system for discharging the exhaust gases, and an exhaust-gas recirculation arrangement which comprises at least one recirculation line, with at least one cooler and at least one control element being provided in the at least one recirculation line for the purposes of setting a predefinable exhaust-gas flow rate for recirculation, and at least one cooler is equipped with a phase-change material, wherein the phase-change material is present either as a liquid phase or as a solid phase depending on the material temperature, and stores heat as the material temperature rises and emits stored heat again as the material temperature falls. A first example of the internal combustion engine further comprises where the at least one cooler has, for the purposes of energy recovery, at least one coolant-conducting coolant jacket which serves for the transfer of heat between the exhaust gas and the coolant. A second example of the internal combustion engine, optionally including the first example, further comprises where a first recirculation line is provided in which a first cooler is arranged and which, using at least one control element, is at least connectable upstream of the first cooler to the exhaust-gas discharge system and downstream of the first cooler to the intake system. A third example of the internal combustion engine, optionally including the first and/or second examples, further includes where the first recirculation line is, downstream of the first cooler, at least connectable selectively to the intake system and/or to the exhaust-gas discharge system using at least one control element. A fourth example of the internal combustion engine optionally including one or more of the first through third examples, further includes where the first recirculation line branches off from the exhaust-gas discharge system so as to form a first junction point and opens into the intake system so as to form a second junction point. A fifth example of the internal combustion engine optionally including one or more of the first through fourth examples, further includes where a first control element is provided in the first recirculation line at the second junction point. A sixth example of the internal combustion engine optionally including one or more of the first through fifth examples, further includes where an exhaust-gas-conducting line is provided which branches off from the first recirculation line downstream of the first cooler so as to form a third junction point and opens into the exhaust-gas discharge system so as to form a fourth junction point. A seventh example of the internal combustion engine optionally including one or more of the first through sixth examples, further includes where a second control element is arranged at the fourth junction point. An eighth example of the internal combustion engine optionally including one or more of the first through seventh examples, further includes where the fourth junction point is arranged in the exhaust-gas discharge system downstream of the first junction point. A ninth example of the internal combustion engine optionally including one or more of the first through eighth examples, further includes where at least one compressor which can be driven by means of an auxiliary drive is arranged in the intake system. A tenth example of the internal combustion engine optionally including one or more of the first through ninth examples, further includes where at least one exhaust-gas turbocharger is provided which comprises a turbine arranged in the exhaust-gas discharge system and a compressor arranged in the intake system. An eleventh example of the internal combustion engine optionally including one or more of the first through tenth examples, further includes where at least one recirculation line opens into the intake system downstream of the compressor. A twelfth example of the internal combustion engine optionally including one or more of the first through eleventh examples, further includes where at least one recirculation line opens into the intake system upstream of the compressor. A thirteenth example of the internal combustion engine optionally including one or more of the first through twelfth examples, further includes where at least one recirculation line branches off from the exhaust-gas discharge system upstream of the turbine. A fourteenth example of the internal combustion engine optionally including one or more of the first through thirteenth examples, further includes where at least one recirculation line branches off from the exhaust-gas discharge system downstream of the turbine. A fifteenth example of the internal combustion engine optionally including one or more of the first through fourteenth examples, further includes where at least one exhaust-gas aftertreatment system is provided in the exhaust-gas discharge system between the turbine and the at least one branching-off recirculation line. A sixteenth example of the internal combustion engine optionally including one or more of the first through fifteenth examples, further includes where a particle filter is provided as exhaust-gas aftertreatment system for the aftertreatment of the exhaust gas. A seventeenth example of the internal combustion engine optionally including one or more of the first through sixteenth examples, further includes where a liquid-type cooling arrangement is provided for forming an engine cooling arrangement. An eighteenth example of the internal combustion engine optionally including one or more of the first through seventeenth examples, further includes where the liquid-type cooling arrangement has a cooling circuit which comprises at least one cooler of the exhaust-gas recirculation arrangement.

An embodiment of an internal combustion engine comprising at least one cylinder, an intake system for supplying air to the at least one cylinder, an exhaust-gas discharge system for the discharge of the exhaust gases, an exhaust-gas recirculation arrangement, which comprises at least two recirculation lines, wherein in each case one cooler is provided in each recirculation line and the coolers are arranged in parallel and are usable independently of one another for cooling exhaust gas, and at least one control element for setting a predefinable exhaust-gas flow rate for recirculation, each cooler is usable for cooling exhaust gas for the purposes of energy recovery. A first example of the internal combustion engine further includes where each cooler has, for the purposes of energy recovery, at least one coolant-conducting coolant jacket which serves for the transfer of heat between the exhaust gas and the coolant. A second example of the internal combustion engine, optionally including the first example, further includes where a first recirculation line is provided in which a first cooler is arranged and which, using at least one control element, is at least connectable upstream of the first cooler to the exhaust-gas discharge system and downstream of the first cooler to the intake system, and a second recirculation line is provided in which a second cooler is arranged and which, using at least one control element, is at least connectable upstream of the second cooler to the exhaust-gas discharge system and downstream of the second cooler selectively to the intake system or to the exhaust-gas discharge system. A third example of the internal combustion engine, optionally including the first and/or second examples, further includes where the first recirculation line is, downstream of the first cooler, at least connectable selectively to the intake system or to the exhaust-gas discharge system using at least one control element. A fourth example of the internal combustion engine, optionally including one or more of the first through third examples, further includes where the first recirculation line branches off from the exhaust-gas discharge system so as to form a first junction point and opens into the intake system so as to form a second junction point. A fifth example of the internal combustion engine, optionally including one or more of the first through fourth examples, further includes where a first control element is provided in the first recirculation line at the second junction point. A sixth example of the internal combustion engine, optionally including one or more of the first through fifth examples, further includes where the second recirculation line branches off from the exhaust-gas discharge system so as to form a third junction point and opens into the first recirculation line downstream of the first cooler so as to form a fourth junction point. A seventh example of the internal combustion engine, optionally including one or more of the first through sixth examples, further includes where a second control element is provided in the second recirculation line downstream of the second cooler. An eighth example of the internal combustion engine, optionally including one or more of the first through seventh examples, further includes where an exhaust-gas-conducting line is provided which branches off from the second recirculation line between the second cooler and the second control element so as to form a fifth junction point and opens into the exhaust-gas discharge system so as to form a sixth junction point. A ninth example of the internal combustion engine, optionally including one or more of the first through eighth examples, further includes where the sixth junction point is arranged in the exhaust-gas discharge system downstream of the first and third junction points. A tenth example of the internal combustion engine, optionally including one or more of the first through ninth examples, further includes where a third control element is arranged at the sixth junction point.

An embodiment of a method comprising flowing exhaust gas heated via an EGR cooler arranged along a recirculation line to an intake system during an engine deactivation; and heating the exhaust gas via an EGR cooler. A first example of the method further comprises where the EGR cooler comprises a phase-change material. A second example of the method, optionally including the first example, further includes where heating the EGR cooler outside of the engine deactivation. A third example of the method, optionally including the first and/or second examples, further includes where heating the EGR cooler comprises a first operational mode and a second operational mode, wherein the first operational mode includes flowing exhaust gas cooled via the EGR cooler to the intake system, and where the second operational mode includes flowing exhaust gas from an exhaust passage to the EGR cooler and back to the exhaust passage without flowing the exhaust gas to the intake system. A fourth example of the method, optionally including one or more of the first through third examples, further includes where the first operational mode further comprises flowing coolant to the EGR cooler, and where the second operational mode comprises the EGR cooler being free of coolant.

An embodiment of a system comprises an engine shaped to receive gases from an intake system and shaped to expel gases to an exhaust system, a recirculation line fluidly coupling the exhaust system to the intake system, the recirculation line comprising a cooler comprising a phase-change material, and a controller with computer-readable instructions stored on memory thereof that when executed enable the controller to initiate a first mode when EGR is desired during engine combustion via opening a first valve and closing a second valve to flow exhaust gas to the intake system from the exhaust system, initiate a second mode when EGR is not desired during engine combustion via closing the first valve and opening the second valve to flow exhaust gas to the cooler and back to the exhaust system, and initiate a third mode when heating via exhaust gas is desired during an engine deactivation via opening the first valve and closing the second valve to flow exhaust gas to the intake system from the exhaust system. A first example of the system further includes where the first mode further comprises flowing coolant to the cooler. A second example of the system, optionally including the first example, further includes where the second mode further comprises not flowing coolant to the cooler. A third example of the system, optionally including the first and/or second examples, further includes where the cooler is a first cooler, and further comprising a second cooler arranged downstream of or parallel to the first cooler, and where each of the first cooler and second cooler comprises the phase-change material. A fourth example of the system, optionally including one or more of the first through third examples, further includes where the third mode further comprises the first valve being in a less open position than a position of the first valve in the first mode. A fifth example of the system, optionally including one or more of the first through fourth examples, further includes where the engine deactivation includes where the engine is unfuelled. A sixth example of the system, optionally including one or more of the first through fifth examples, further includes where the third mode further includes an EGR request being absent. A seventh example of the system, optionally including one or more of the first through sixth examples, further includes where the second mode is an energy recuperative mode, and where heat from the exhaust gas is transferred to the phase-change material before being redirected to the exhaust system. An eighth example of the system, optionally including one or more of the first through seventh examples, further includes where the third mode comprises where heating the exhaust gas further comprises cooling the phase-change material. A ninth example of the system, optionally including one or more of the first through eighth examples, further includes where the exhaust gas in the third mode comprises a composition different than the exhaust gas in the first mode, and where the exhaust gas in the third mode comprises less hydrocarbons than the exhaust gas in the first mode.

An embodiment of a method comprises flowing exhaust gas having a first temperature to a cooler before flowing the exhaust gas to an intake system during a first operating mode, flowing exhaust gas having the first temperature to the cooler before flowing the exhaust gas to an exhaust system during a second operating mode, and flowing exhaust gas having a second temperature different than the first temperature to the cooler before flowing the exhaust gas to the intake system during a third operating mode, where an engine is combusting in the first and second operating modes and where the engine is deactivated during the third operating mode, and where the cooler comprises a phase-change material. A first example of the method further includes where heating the phase-change material of the cooler during the first and second operating modes, and cooling the phase-change material of the cooler during the third operating mode. A second example of the method, optionally including the first example, further includes where the cooler warms the exhaust gas during the third operating mode, and where the exhaust gas in the third operating mode heats or maintains an engine temperature when the engine is deactivated. A third example of the method, optionally including the first and/or second examples, further includes where the cooler is arranged in an EGR passage fluidly coupling the exhaust system to the intake system, further comprising a first control element arranged at a junction between the EGR passage and the intake system, wherein the first control element is at least partially open during the first and third operating modes and closed during the second operating mode, further comprising a further exhaust-gas-conducting line fluidly coupling a portion of the EGR passage downstream of the cooler to the exhaust system, and where a second control element is arranged in the further exhaust-gas-conducting line, wherein the second control element is at least partially open during the second operating mode and closed during the first and third operating modes. A fourth example of the method, optionally including one or more of the first through third examples, further includes where the first operating mode further comprises an EGR request being present and where the third operating mode comprising the EGR request being absent.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

deactivating an engine including stopping fuel injection but still flowing gasses to an exhaust without combusted fuel;

heating the gasses in the exhaust via an EGR cooler arranged along a recirculation line to an intake system with the engine deactivated, wherein the EGR cooler comprises a phase-change material and wherein the heating transfers previously stored heat in the phase-change material from exhaust with combusted fuel to the gasses in the exhaust without combusted fuel.

2. The method of claim 1, further comprising heating the EGR cooler outside of the engine deactivation.

3. The method of claim 2, wherein heating the EGR cooler comprises a first operational mode and a second operational mode, wherein the first operational mode includes flowing exhaust gas cooled via the EGR cooler to the intake system, and where the second operational mode includes flowing exhaust gas from an exhaust passage to the EGR cooler and back to the exhaust passage without flowing the exhaust gas to the intake system.

4. The method of claim 3, wherein the first operational mode further comprises flowing coolant to the EGR cooler, and where the second operational mode comprises the EGR cooler being free of coolant.

5. A system comprising:

an engine shaped to receive gases from an intake system and shaped to expel gases to an exhaust system;

a recirculation line fluidly coupling the exhaust system to the intake system, the recirculation line comprising a cooler comprising a phase-change material; and a controller with computer-readable instructions stored on memory thereof that when executed enable the controller to:

initiate a first mode when EGR is desired during engine combustion via opening a first valve and closing a second valve to flow exhaust gas to the intake system from the exhaust system;

initiate a second mode when EGR is not desired during engine combustion via closing the first valve and opening the second valve to flow exhaust gas to the cooler and back to the exhaust system; and initiate a third mode when heating via exhaust gas is desired during an engine deactivation via opening the first valve and closing the second valve to flow exhaust gas without combusted fuel to the intake system from the exhaust system.

6. The system of claim 5, wherein the first mode further comprises flowing coolant to the cooler.

7. The system of claim 5, wherein the second mode further comprises blocking coolant flow to the cooler.

8. The system of claim 5, wherein the cooler is a first cooler, and further comprising a second cooler arranged downstream of or parallel to the first cooler, and where each of the first cooler and the second cooler comprises the phase-change material.

9. The system of claim 5, wherein the third mode further comprises the first valve being in a less open position than a position of the first valve in the first mode.

10. The system of claim 5, wherein the engine deactivation includes where the engine is unfuelled.

11. The system of claim 5, wherein the third mode further includes an EGR request being absent.

12. The system of claim 5, wherein the second mode is an energy recuperative mode, and where heat from the exhaust gas is transferred to the phase-change material before being redirected to the exhaust system.

13. The system of claim 5, wherein the third mode comprises where heating the exhaust gas further comprises cooling the phase-change material.

14. The system of claim 5, wherein the exhaust gas in the third mode comprises a composition different than the exhaust gas in the first mode, and where the exhaust gas in the third mode comprises less hydrocarbons than the exhaust gas in the first mode.

15. A method comprising:

flowing exhaust gas having a first temperature to a cooler before flowing the exhaust gas to an intake system during a first operating mode;

flowing exhaust gas having the first temperature to the cooler before flowing the exhaust gas to an exhaust system during a second operating mode; and flowing exhaust gas without combusted fuel having a second temperature different than the first temperature to the cooler before flowing the exhaust gas to the intake system during a third operating mode, where an engine is combusting in the first and second operating modes and where the engine is deactivated during the third operating mode, and where the cooler comprises a phase-change material, where during the third operating mode, heat is transferred from the phase-change material to the gas without combusted fuel.

16. The method of claim 15, further comprising heating the phase-change material of the cooler during the first and second operating modes, and cooling the phase-change material of the cooler during the third operating mode.

17. The method of claim 15, wherein the cooler warms the exhaust gas during the third operating mode, and where the exhaust gas in the third operating mode heats or maintains an engine temperature when the engine is deactivated.

18. The method of claim 15, wherein the cooler is arranged in an EGR passage fluidly coupling the exhaust system to the intake system, further comprising a first control element arranged at a junction between the EGR passage and the intake system, wherein the first control element is at least partially open during the first and third operating modes and closed during the second operating mode, further comprising a further exhaust-gas-conducting line fluidly coupling a portion of the EGR passage downstream of the cooler to the exhaust system, and where a second control element is arranged in the further exhaust-gas-conducting line, wherein the second control element is at least partially open during the second operating mode and closed during the first and third operating modes.

19. The method of claim 18, wherein the first operating mode further comprises an EGR request being present and where the third operating mode comprises the EGR request being absent.

* * * * *